US010248042B2

(12) United States Patent
Uematsu et al.

(10) Patent No.: US 10,248,042 B2
(45) Date of Patent: Apr. 2, 2019

(54) ELECTROPHOTOGRAPHIC ROLLER, PROCESS CARTRIDGE AND ELECTROPHOTOGRAPHIC APPARATUS

(71) Applicant: CANON KABUSHIKI KAISHA, Tokyo (JP)

(72) Inventors: Atsushi Uematsu, Fuji (JP); Mototeru Goto, Yokohama (JP); Masataka Kodama, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/991,191

(22) Filed: May 29, 2018

(65) Prior Publication Data

US 2018/0348661 A1 Dec. 6, 2018

(30) Foreign Application Priority Data

Jun. 2, 2017 (JP) ..... 2017-110118
Apr. 26, 2018 (JP) ..... 2018-085816

(51) Int. Cl.
*G03G 15/00* (2006.01)
*G03G 15/02* (2006.01)
(Continued)

(52) U.S. Cl.
CPC ..... *G03G 15/0233* (2013.01); *G03G 5/14708* (2013.01); *G03G 15/0818* (2013.01);
(Continued)

(58) Field of Classification Search
CPC ..... G03G 15/0233; G03G 15/0818; G03G 15/1685; G03G 5/14708; G03G 2215/025; G03G 2215/183
See application file for complete search history.

(56) References Cited

U.S. PATENT DOCUMENTS 8,383,234 B2 2/2013 Mayuzumi et al.
8,503,911 B2 8/2013 Suzumura et al.
(Continued)

FOREIGN PATENT DOCUMENTS

EP 1 355 201 10/2003
EP 2 787 394 8/2014
(Continued)

*Primary Examiner* — David M. Gray
*Assistant Examiner* — Michael A Harrison
(74) *Attorney, Agent, or Firm* — Venable LLP

(57) ABSTRACT

The electrophotographic roller has a surface layer comprising an electro-conductive elastic layer on an electro-conductive substrate. The opening of a bowl-shaped resin particle is exposed on the surface of the electrophotographic roller. The number of contact portions of the convex portion with the glass plate in a square region where a length of a nip in a direction along the circumferential direction of the electrophotographic roller of a nip formed by pressing the roller on the glass plate with a specific load applied as the length of one side and is located at any position in the nip is 8 or more. The average value of the areas of the contact portions is 10 $\mu m^2$ to 111 $\mu m^2$. The variation coefficient of the areas of the contact portions and the variation coefficient D of the areas of a plurality of Voronoi regions each including a contact portion satisfy specific relationships.

15 Claims, 11 Drawing Sheets

(51) Int. Cl.

| | |
|---|---|
| ***G03G 15/08*** | (2006.01) |
| ***G03G 15/16*** | (2006.01) |
| ***G03G 5/147*** | (2006.01) |

(52) U.S. Cl.

CPC ... *G03G 15/1685* (2013.01); *G03G 2215/025* (2013.01); *G03G 2221/183* (2013.01)

(56) References Cited

U.S. PATENT DOCUMENTS

| | | | | |
|---|---|---|---|---|
| 8,526,857 | B2 | 9/2013 | Tomomizu et al. | |
| 8,548,359 | B2 | 10/2013 | Taniguchi et al. | |
| 9,075,333 | B2 | 7/2015 | Uematsu et al. | |
| 9,098,006 | B2 | 8/2015 | Uematsu et al. | |
| 9,274,442 | B2 | 3/2016 | Sato et al. | |
| 9,411,307 | B2 | 9/2016 | Matsuda et al. | |
| 9,448,502 | B2 | 9/2016 | Taniguchi et al. | |
| 9,547,250 | B2 | 1/2017 | Kikuchi et al. | |
| 9,556,359 | B2 | 1/2017 | Suzumura et al. | |
| 9,599,914 | B2 | 3/2017 | Uematsu et al. | |
| 9,989,879 | B2 | 6/2018 | Doi et al. | |
| 2013/0004206 | A1 | 1/2013 | Kuroda et al. | |
| 2013/0034369 | A1 | 2/2013 | Masu et al. | |
| 2013/0064571 | A1 | 3/2013 | Kodama et al. | |
| 2014/0072343 | A1 | 3/2014 | Masu et al. | |
| 2014/0080691 | A1 | 3/2014 | Kurachi et al. | |
| 2014/0301754 | A1* | 10/2014 | Uematsu | G03G 15/0233 399/176 |
| 2015/0198904 | A1 | 7/2015 | Kikuchi et al. | |
| 2015/0198906 | A1* | 7/2015 | Yamauchi | G03G 15/0233 492/18 |
| 2015/0331348 | A1 | 11/2015 | Doi et al. | |
| 2016/0291487 | A1 | 10/2016 | Uematsu et al. | |
| 2016/0299450 | A1 | 10/2016 | Takeno et al. | |
| 2018/0024460 | A1* | 1/2018 | Uematsu | G03G 15/0233 399/176 |

FOREIGN PATENT DOCUMENTS

| | | |
|---|---|---|
| EP | 3 051 358 | 8/2016 |
| JP | 2011-237470 | 11/2011 |
| JP | 2014-211624 | 11/2014 |
| JP | 2015-087768 | 5/2015 |
| JP | 2016-197235 | 11/2016 |
| JP | 2016-197236 | 11/2016 |
| WO | 2016/159387 | 10/2016 |

* cited by examiner

ELECTROPHOTOGRAPHIC ROLLER, PROCESS CARTRIDGE AND ELECTROPHOTOGRAPHIC APPARATUS

BACKGROUND OF THE INVENTION

Field of the Invention

The present disclosure relates to an electrophotographic roller, a process cartridge and an electrophotographic apparatus including the electrophotographic roller.

Description of the Related Art

Japanese Patent Application Laid-Open No. 2014-211624 discloses a roller member for electrophotographic that can be used as an charging roller or the like and that has an electro-conductive substrate and an electro-conductive elastic layer as a surface layer, wherein the surface of the surface layer has a concave portion derived from the opening of a bowl-shaped resin particle and a convex portion derived from the edges of the opening. In Japanese Patent Application Laid-Open No. 2014-211624, uneven wear of a photosensitive member that a roller member contacts is suppressed, and the driven rotatability of the roller member and a photosensitive member drum is improved by defining the restoration speeds of the deformation of the surface at the central portion and the end portion of the roller member in the longitudinal direction and the deformation thereof in the depth direction.

As a result of the examination of the present inventors, although the roller member according to Japanese Patent Application Laid-Open No. 2014-211624 had excellent driven rotatability by the photosensitive member drum, the roller member still had room for improvement in further speeding up process speed in recent years.

SUMMARY OF THE INVENTION

An aspect of the present disclosure is directed to providing an electrophotographic roller that is further improved in driven rotatability by a photosensitive member drum.

Another aspect of the present disclosure is directed to providing a process cartridge that serves to form high-definition electrophotographic images.

Further aspect of the present disclosure is directed to providing an electrophotographic apparatus that can form a high-definition electrophotographic images.

According to an aspect of the present disclosure, there is provided an electrophotographic roller, having an electro-conductive substrate and an electro-conductive elastic layer as the surface layer on the electro-conductive substrate, wherein the elastic layer contains a binder and retains a bowl-shaped resin particle having an opening in the state where the opening is exposed on the surface of the electrophotographic roller, the surface of the electrophotographic roller has a concave portion derived from the opening of the bowl-shaped resin particle exposed on the surface and a convex portion derived from an edge of the opening of the bowl-shaped resin particle exposed on the surface, a part of the surface of the electrophotographic roller is constituted by the elastic layer, when the electrophotographic roller is pressed on a glass plate so that a load per the unit area of a nip formed by the electrophotographic roller and the glass plate is 6.5 g/mm$^2$ or more and 14.3 g/mm$^2$ or less, and a square region having a side whose length is equal to a length of the nip in the direction along the circumferential direction of the electrophotographic roller put in the nip, in the square region, the convex portion and the glass plate are in contact with each other, and a number of the contact portion is 8 or more, the average value Save of the areas of the contact portion is 10 μm$^2$ or more and 111 μm$^2$ or less, the variation coefficient S of the areas of the contact portion satisfies the following Expression (1), and the variation coefficient D of the areas of Voronoi regions each including the contact portion satisfies the following Expression (2):

$$0.68 \leq S \leq 1.00; \quad \text{Expression (1)}$$

$$0.85 \leq D \leq 1.20. \quad \text{Expression (2)}$$

According to another aspect of the present disclosure, there is provided a process cartridge attachable to and detachable from a main body of an electrophotographic apparatus, comprising the above-mentioned electrophotographic roller and an electrophotographic photosensitive member.

According to further aspect of the present disclosure, there is provided an electrophotographic apparatus comprising the afore-mentioned electrophotographic roller and an electrophotographic photosensitive member.

Further features of the present disclosure will become apparent from the following description of exemplary embodiments with reference to the attached drawings.

DESCRIPTION OF THE EMBODIMENTS

Figure 1A:
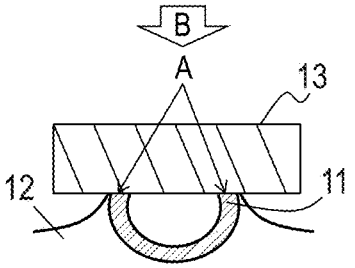
FIG. 1A is a cross-sectional view for describing an abutment state of a convex portion derived from an edge of the opening of a bowl-shaped resin particle with a glass plate.

Preferred embodiments of the present disclosure will now be described in detail in accordance with the accompanying drawings.

The electrophotographic roller according to the present disclosure includes an electro-conductive substrate and an electro-conductive elastic layer as a surface layer on the electro-conductive substrate. The elastic layer includes a binder, and retains a bowl-shaped resin particle having an opening in the state where the opening is exposed on the surface of the electrophotographic roller. A part of the surface of the electrophotographic roller is constituted by the elastic layer.

Furthermore, the surface of the electrophotographic roller includes a concave portion derived from the opening of the bowl-shaped resin particle exposed on the surface and a convex portion (hereinafter, also referred to as "edge portions") derived from an edge of the opening of the bowl-shaped resin particle, exposed on the surface.

In the electrophotographic roller according to the present disclosure, when a square region having a side whose length is equal to the length of the nip in a direction along the circumferential direction of the electrophotographic roller (hereinafter, also referred to as "circumferential direction length of nip") is put at any position in the nip in the following test conditions, in the square region, the convex portion and the glass plate are in contact with each other, and a number of the contact portion is 8 or more, and satisfies the following expression (1) and the following expression (2).

Herein, the "nip" means a contact portion of the electrophotographic roller with the glass plate, and more specifically means a region sandwiched between two straight lines in parallel with the longitudinal direction of the electrophotographic roller, the lines passing through two respective contact points of the electrophotographic roller with the glass plate at both ends in the circumferential direction as a direction orthogonal to the longitudinal direction of the electrophotographic roller.

$$0.68 \leq S \leq 1.00 \quad \text{Expression (1)}$$

$$0.85 \leq D \leq 1.20 \quad \text{Expression (2)}$$

(Test Conditions)

The glass plate is placed in the longitudinal direction of the electrophotographic roller, namely, over the entire width of an axis (in the rotation center axis direction). In such a state, the glass plate is allowed to abut with the electrophotographic roller by pressing so that the load per unit area of the nip formed by the electrophotographic roller and the glass plate is 6.5 g/mm$^2$ or more and 14.3 g/mm$^2$ or less. The area variation coefficient of contact portions of edge portions with the glass plate in the abutment state is defined as S, and the area variation coefficient of Voronoi polygons formed by Voronoi tessellation of the contact portions is defined as D.

As the load per unit area of the nip, the above range is adopted in consideration of the abutment load to a photosensitive member of an electrophotographic roller in a common electrophotographic apparatus, and the nip area in pressing by the abutment load.

The glass plate is obtained by modelization of a member such as a photosensitive member with which the electrophotographic roller abuts, and the glass plate can be used to thereby allow the abutment state of the electrophotographic roller with such a member as a photosensitive member to be visualized in a simulated manner according to an observation procedure described below.

A case where the electrophotographic roller is used as a member that is brought into contact with a photosensitive member and thus followingly rotated is described below in terms of a relationship between the surface structure of the elastic layer of the electrophotographic roller, and the expression (1) and expression (2).

FIG. 1A is a view illustrating one state example where a concave and convex structure formed by a bowl-shaped resin particle having an opening retained on the elastic layer surface is pressed on a flat surface for contact of the glass plate, as a partial cross-section in the thickness direction of the elastic layer and the glass plate. As illustrated in FIG. 1A, such a concave and convex structure is pressed on the glass plate, thereby allowing an edge portion derived from an opening of a bowl-shaped resin particle 11 dispersed in a binder 12 to be brought into contact with one surface of a glass plate 13.

Next, the area variation coefficient S of the contact portions of the edge portions with the glass plate is described.

Figure 1B:
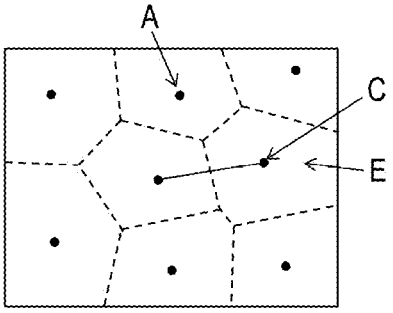
FIG. 1B is a diagram illustrating one example of contact portions of convex portions derived from edges of the openings of resin particles with a glass plate.

Reference numeral A in FIG. 1A represents contact portions of an edge portion with the glass plate 13, and, when such contact portions A are observed from the direction of an arrow B, namely, the direction opposite to a contact surface of the glass plate with the edge portion by a microscope, multiple contact portions A are confirmed as illustrated in FIG. 1B. When the area of each of the contact portions A in FIG. 1B is calculated with respect to all the contact portions A, and the average is defined as Save and the standard deviation is defined as Sσ, the variation coefficient as the value obtained by dividing Sσ by Save is defined as S. S is an index representing the area distribution of the contact portions A of the edge portions with the photosensitive member, and it is indicated that a smaller S means a more uniform area among the contact portions.

Next, the area variation coefficient D of multiple Voronoi regions that are formed by Voronoi tessellation of the contact portions of the edge portions with the glass plate and that include each of the contact portions is described.

The contact portions A illustrated in FIG. 1B can be subjected to Voronoi tessellation, thereby providing Voronoi regions E. When the area of each of the Voronoi regions E is calculated, and the average is defined as Dave and the standard deviation is defined as Dσ, the variation coefficient as the value obtained by dividing Dσ by Dave is defined as D.

Next, the Voronoi regions are described.

Such Voronoi regions are regions formed by Voronoi tessellation. Specifically, Voronoi tessellation is performed according to the following procedure.

When multiple points (hereinafter, each also referred to as "mother points") are present in an image region, all adjacent mother points are connected by straight lines, and a perpendicular bisector is made with respect to each basic straight line for connection of adjacent two mother points. When perpendicular bisectors elongated from adjacent basic straight lines are linked, a region where one mother point is surrounded by such perpendicular bisectors is generated. The region surrounded by such perpendicular bisectors is called a Voronoi region. A point at which a straight line for connection of adjacent two mother points and the perpendicular bisectors thereof are crossed indicates the shortest distance from each mother point, and the size (area) of the Voronoi region surrounded and formed by the perpendicular bisectors represents the distance between adjacent mother points. In other words, when the distance between adjacent mother points is increased, the area of the Voronoi region is also increased.

Herein, the mother points by Voronoi tessellation are expanded to an objective other than a point, and the distance between contact portions is evaluated. Specifically, such evaluation is performed according to the following method.

Figure 1C:
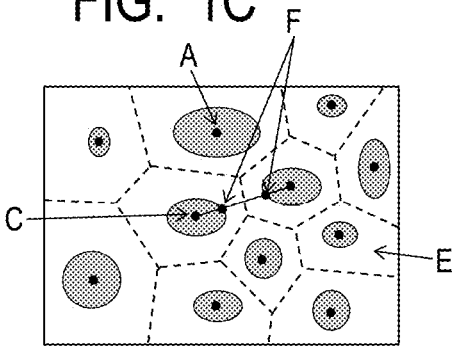
FIG. 1C is a diagram illustrating one example of Voronoi tessellation of the contact portions of convex portions derived from edges of the openings of resin particles with a glass plate.

As illustrated in FIG. 1C, the gravity center (C in FIG. 1C) of each of the contact portions of the edge portion with the photosensitive member is calculated. All the gravity centers of adjacent contact portions are connected by straight lines to provide basic straight lines, and the intersection points (F in FIG. 1C) of the outer peripheries of the contact portions with the basic straight lines are calculated. Such intersection points F are each made by two points on the straight line for connection of one gravity center and one gravity center. The perpendicular bisector between such two intersection points is made. The perpendicular bisectors made from such adjacent contact portions are linked to thereby generate a region where one of the contact portions is surrounded by the perpendicular bisectors, and such a region is herein defined as the Voronoi region. The Voronoi region exhibits the distance between the contact portions, and the variation coefficient D can be utilized as an index representing the distribution of the distance between the contact portions A, and it can be considered that, as D is smaller, the distance between the contact portions A is more uniform and the distribution is narrower.

The uniformity of the contact portions of the edge portions with the photosensitive member can be represented by S and D described above, and as S is smaller and D is smaller, the contact portions of the edge portions with the photosensitive member is narrow in the area distribution and also narrow in the distribution of the distance between the contact portions. Accordingly, S and D can be each selected within a suitable range, thereby stabilizing the abutment state of the electrophotographic roller with the photosensitive member. Consequently, when the electrophotographic roller and the photosensitive member are followingly rotated, following rotation property can be enhanced and the rotation variation can be reduced to suppress the contamination variation due to the rotation variation.

In the present disclosure, S representing the area distribution of the contact portions of the edge portions with the photosensitive member satisfies the range represented by the expression (1). When S is 1.00 or less or is preferably 0.90 or less, the area distribution of the contact portions can be narrower, and following rotation property between the electrophotographic roller and the photosensitive member can be enhanced. The lower limit of S is set to 0.68. The reason is because a procedure for allowing S to be less than 0.68 cannot be found in the present configuration where the electro-conductive elastic layer contains the binder and the bowl-shaped resin particle.

In the present disclosure, D representing the distribution of the distance between the contact portions of the edge portion with the photosensitive member satisfies the range represented by the expression (2). When D is 1.20 or less or is preferably 1.10 or less, the distribution of the distance between the contact portions can be narrower, and following rotation property between the electrophotographic roller and the photosensitive member can be enhanced. The lower limit of D is set to 0.85. The reason is because a procedure for allowing D to be less than 0.85 cannot be found in the present configuration where the electro-conductive elastic layer contains the binder and the bowl-shaped resin particle.

As described above, the electrophotographic roller satisfying the expression (1) and the expression (2) is narrow in the area distribution of the contact portions of the edge portions with the photosensitive member and also narrow in the distribution of the distance between the contact portions. Therefore, the abutment state is homogeneous in the rotation direction during following rotation of the electrophotographic roller and the photosensitive member, resulting in an enhancement in following rotation property, and the rotation variation is decreased, resulting in suppression of the contamination variation due to the rotation variation.

With respect to the number of the contact portions of the edge portions with the glass plate, when pressing is made so that the load per unit area of the nip formed by the electrophotographic roller and the glass plate is 6.5 g/mm$^2$ or more and 14.3 g/mm$^2$ or less and a square region where the length of the nip in a direction along with the circumferential direction of the electrophotographic roller is defined as the length of one side is located at any position in the nip, the number of the contact portions of the convex portion with the glass plate in the square region is 8 or more. That is, even when the square region is located at any position in the nip, the number of the contact portions included in the square region is 8 or more.

When the load is 6.5 g/mm$^2$, the number of the contact portion included in the square region can be 8 or more and 50 or less.

When the load is 10.9 g/mm$^2$, the number of the contact portion included in the square region can be 10 or more and 60 or less.

When the load is 14.3 g/mm$^2$, the number of the contact portion included in the square region can be 20 or more and 70 or less.

In order to further enhance the effect of suppression of the contamination variation due to a reduction in rotation variation owing to S and D satisfying the expression (1) and expression (2), the contact portions can be present at a density of 40 portions/mm$^2$ or more and 190 portions/mm$^2$ or less.

The Save is smaller, the area of each of the contact portions of the edge portions with the photosensitive member, present on the electrophotographic roller surface, is decreased to result in not only a reduction in contamination variation, but also a reduction in the amount of contamination itself. Accordingly, Save is 10 μm$^2$ or more and 111 μm$^2$ or less, and preferably be 10 μm$^2$ or more and 40 μm$^2$ or less.

A case where not only D satisfies the expression (2), but also the Dave is smaller, can be adopted because the distance between the adjacent contact portions of the edge portions with the photosensitive member, present on the electrophotographic roller surface, is decreased to allow the abutment state to be stabilized and to allow following rotation property to be enhanced, resulting in an enhancement in the effect of suppression of the contamination variation due to the rotation variation. Specifically, Dave can be 1300 μm$^2$ or more and 3000 μm$^2$ or less.

<Glass Plate>

As the glass plate, for example, a glass plate is used which has a material of BK 7, a surface accuracy by optical polishing of both surfaces, a parallelism of 1 minute or less and a thickness of 2 mm. As previously described in FIG. 1A, a surface formed as one flat surface of the glass plate can be utilized as a surface for contact, onto which the electrophotographic roller is to be pressed, and a surface opposite thereto can be utilized as a surface for observation of the contact portions. The width (W2) of the glass plate is equal to or more than the width (W1) in the axis (rotation axis)

direction (namely, longitudinal direction) of the electrophotographic roller (W1≤W2). The length (L) in the direction orthogonal to the width (W2) of the glass plate may be set so that a nip portion for providing information necessary for calculation of S and D described above can be formed. For example, the length (L) can be equal to or more than the length in the direction orthogonal to the axis of the electrophotographic roller, namely, the outer diameter.

<Electrophotographic Roller>

Figure 2A:
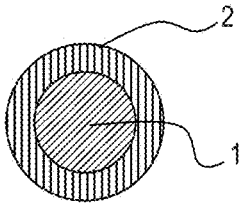
FIG. 2A and FIG. 2B include schematic cross-sectional views each illustrating one example of the electrophotographic roller according to the present disclosure.
Figure 2B:
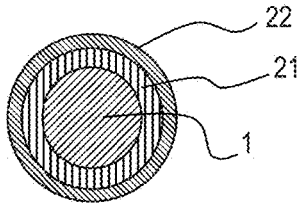

FIG. 2A and FIG. 2B each illustrate a schematic view of one example of the cross section of the electrophotographic roller. An electrophotographic roller in FIG. 2A includes an electro-conductive substrate 1 and an electro-conductive elastic layer 2. The electro-conductive elastic layer may have a bilayer structure of electro-conductive elastic layers 21 and 22, as illustrated in FIG. 2B.

The electro-conductive substrate 1 and the electro-conductive elastic layer 2, or layers (for example, electro-conductive elastic layer 21 and electro-conductive elastic layer 22 illustrated in FIG. 2B) sequentially stacked on the electro-conductive substrate 1 may be bonded with an adhesive interposed therebetween. The adhesive can be here electro-conductive. A known adhesive can be used as the electro-conductive adhesive.

Examples of the base material of the adhesive include a thermosetting resin and a thermoplastic resin, and a known material such as a urethane-type, acrylic, polyester-type, polyether-type or epoxy-type material can be used. An electro-conductive agent for imparting electro-conductivity to the adhesive can be appropriately selected from electro-conductive fine particles detailed below, and can be used singly or in combinations of two or more types thereof.

[Electro-Conductive Substrate]

The electro-conductive substrate is a substrate that has electro-conductivity and that functions to support the electro-conductive elastic layer provided thereon. Examples of the material can include metals such as iron, copper, aluminum and nickel, and alloys thereof (stainless steel and the like).

[Electro-Conductive Elastic Layer]

Figure 4A:
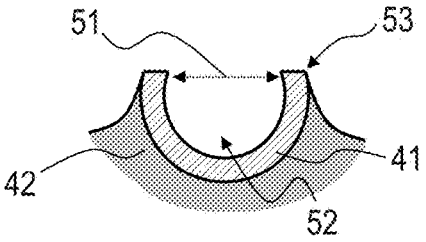
FIG. 4A, FIG. 4B and FIG. 4C include partial cross-sectional views each illustrating the vicinity of the surface of one example of the electrophotographic roller according to the present disclosure.
Figure 4B:
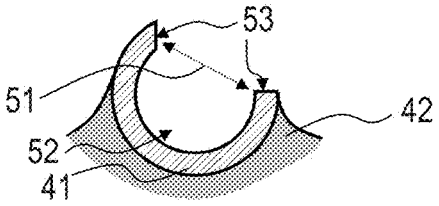

FIG. 4A and FIG. 4B are each a partial cross-sectional view of the vicinity of the surface of an electro-conductive elastic layer forming the surface layer of the electrophotographic roller. A bowl-shaped resin particle 41, a part of which is contained in the electro-conductive elastic layer, is exposed on the surface of the electrophotographic roller. The surface of the electrophotographic roller includes a concave portion 52 derived from an opening 51 of the bowl-shaped resin particle 41 exposed on the surface, and an edge portion as a convex portion derived from an edge 53 of the opening 51 of the bowl-shaped resin particle 41 exposed on the surface. A portion made of a binder 42 is formed on the periphery of the bowl-shaped resin particle 41 exposed on the surface. The edge 53 can have a form illustrated in FIG. 4A, FIG. 4B and the like.

Figure 4C:
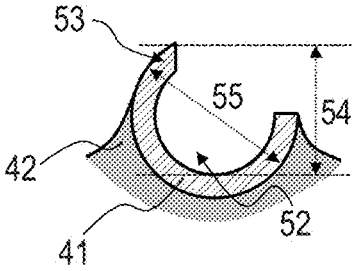

The height difference 54 between the vertex of the edge portion and the bottom of the concave portion 52 defined by a shell of the bowl-shaped resin particle 41, illustrated in FIG. 4C, is 5 μm or more and 100 μm or less and is particularly preferably 10 μm or more and 88 μm or less. Such a range can be set to thereby allow point contact of an edge portion in a nip portion formed by the electrophotographic roller and the photosensitive member to be more certainly maintained. The ratio of the maximum size 55 of the bowl-shaped resin particle to the height difference 54 between the vertex of the edge portion and the bottom of the concave portion, namely, the [maximum size]/[height difference] of the resin particle is preferably 0.8 or more and 3.0 or less, particularly preferably 1.1 or more and 1.6 or less. The [maximum size]/[height difference] of the resin particle can be within such a range, thereby allowing point contact of an edge of a bowl in the nip portion formed by the electrophotographic roller and the photosensitive member to be more certainly maintained. In the present disclosure, the "maximum size" of the bowl-shaped resin particle is defined as the maximum length in a circular projection image provided by the bowl-shaped resin particle. When the bowl-shaped resin particle provides multiple circular projection images, the maximum value among the maximum lengths in the respective projection images is defined as the "maximum size" of the bowl-shaped resin particle.

The surface state of the electro-conductive elastic layer can be controlled by the concave and convex shape, as follows. That is, the ten-point surface roughness (Rzjis) of a surface forming the outer surface of the electrophotographic roller, the surface being opposite to a surface facing the electro-conductive substrate of the elastic layer, is 5 μm or more and 75 μm or less and is particularly preferably 10 μm or more and 50 μm or less. The average concave and convex interval (Sm) of the surface is 30 μm or more and 200 μm or less and is particularly preferably 40 μm or more and 154 μm or less. Such ranges can be set to thereby allow point contact of an edge of a bowl in the nip portion formed by the electrophotographic roller and the photosensitive member to be more certainly maintained. The measurement methods of the ten-point surface roughness (Rzjis) of the surface and the average concave and convex interval (Sm) of the surface are described below.

One example of the bowl-shaped resin particle is illustrated in FIG. 5A to FIG. 5E.

Figure 5A:
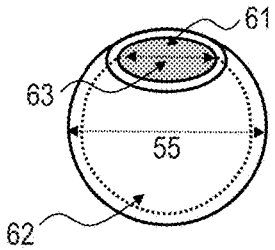
FIG. 5A, FIG. 5B, FIG. 5C, FIG. 5D and FIG. 5E include illustration views each illustrating the shape of a bowl-shaped resin particle for use in the present disclosure.
Figure 5B:
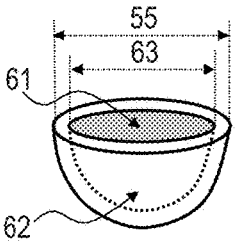
Figure 5C:
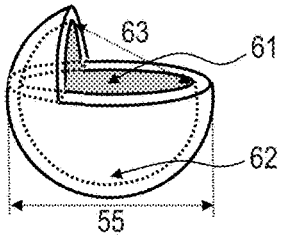
Figure 5D:
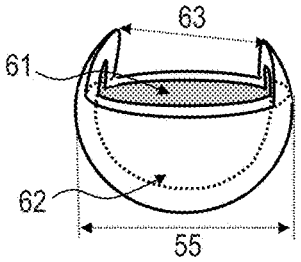
Figure 5E:
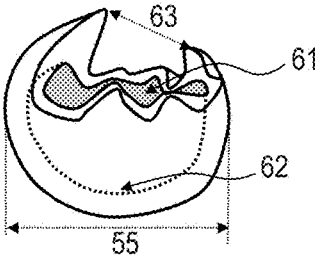

In the present disclosure, the "bowl-shape" means a shape having an opening portion 61 and a roundish concave portion 62. The "opening portion" may be a flat bowl edge as illustrated in FIG. 5A and FIG. 5B, or may have a concave and convex bowl edge as illustrated in FIG. 5C to FIG. 5E.

The target of the maximum size 55 of the bowl-shaped resin particle is 10 μm or more and 150 μm or less, preferably 18 μm or more and 102 μm or less. The ratio of the maximum size 55 of the bowl-shaped resin particle to the minimum size 63 of the opening portion, namely, [maximum size]/[minimum size of opening portion] of the bowl-shaped resin particle can be 1.1 or more and 4.0 or less. Such ranges can be set to thereby allow the declining movement of the bowl-shaped resin particle into the electro-conductive elastic layer, in the nip portion formed by the photosensitive member and the electrophotographic roller, to be more certainly obtained.

The thickness (the difference between the outer diameter and the inner diameter of the edge) of a shell on the periphery of the opening portion of the bowl-shaped resin particle is 0.1 μm or more and 3 μm or less and is particularly preferably 0.2 μm or more and 2 μm or less. Such a range can be set to thereby allow the declining movement of the bowl-shaped resin particle into the electro-conductive elastic layer, in a nip portion described below, to be more certainly obtained. With respect to the thickness of the shell, the "maximum thickness" is preferably three times or less, more preferably twice or less the "minimum thickness".

[Binder]

A known rubber or resin can be used as the binder contained in the electro-conductive elastic layer. Examples of the rubber can include natural rubber and such rubber vulcanized, and synthetic rubber. Examples of the synthetic rubber include the following: ethylene/propylene rubber, styrene/butadiene rubber (SBR), silicone rubber, urethane rubber, isopropylene rubber (IR), butyl rubber, acrylonitrile/butadiene rubber (NBR), chloroprene rubber (CR), butadiene rubber (BR), acrylic rubber, epichlorohydrin rubber and fluororubber.

As the resin, a resin such as a thermosetting resin or a thermoplastic resin can be used. In particular, a fluororesin, a polyamide resin, an acrylic resin, a polyurethane resin, an acrylic urethane resin, a silicone resin and a butyral resin are more preferable. Such resins may be used singly or in combination of two or more types thereof. In addition, monomers of such resins may be copolymerized to provide a copolymer.

[Electro-Conductive Fine Particle]

The target of the volume resistivity of the electro-conductive elastic layer can be $1\times10^{2}$ Ωcm or more and $1\times10^{16}$ Ωcm or less under an environment of a temperature of 23° C. and a relative humidity of 50%. Such a range can be set to thereby allow an electrographic photosensitive member to be properly charged by discharge. In order to achieve such a target, a known electro-conductive fine particle may also be contained in the electro-conductive elastic layer. Examples of the electro-conductive fine particle include respective fine particles of a metal oxide, a metal, carbon black and graphite. Such electro-conductive fine particles may be used singly or in combinations of two or more types thereof. The target of the content of the electro-conductive fine particle in the electro-conductive elastic layer is 2 parts by mass or more and 200 parts by mass or less and is particularly 5 parts by mass or more and 100 parts by mass or less, based on 100 parts by mass of the binder.

[Method for Forming Electro-Conductive Elastic Layer]

An example of the method for forming the electro-conductive elastic layer is described below. First, a covering layer in which a hollow-shaped resin particle is dispersed in a binder is formed on an electro-conductive substrate. Thereafter, the surface of the covering layer is polished, thereby deleting a part of the hollow-shaped resin particle to provide a bowl shape, to form a concave portion due to an opening of the bowl-shaped resin particle and a convex portion due to an edge of the opening of the bowl-shaped resin particle (hereinafter, a shape having such concave and convex is referred to as "concave and convex shape due to the opening of the bowl-shaped resin particle".). An electro-conductive resin layer is thus formed and then heat-treated for thermal curing. Herein, a covering layer before a polishing step, as the covering layer, is referred to as "pre-covering layer".

[Dispersion of Resin Particle in Pre-Covering Layer]

First, the method for dispersing the hollow-shaped resin particle in the pre-covering layer is described. One example can be a method including forming a coating film of an electro-conductive resin composition, in which the hollow-shaped resin particle containing gas therein is dispersed in the binder, on a substrate, and subjecting the coating film to drying, curing, crosslinking or the like. Herein, the electro-conductive resin composition can contain an electro-conductive particle.

As the material for use in the hollow-shaped resin particle, a resin having a polar group is preferable, and a resin having a unit represented by the following chemical formula (4) is more preferable, from the viewpoints of being low in air permeability and having a high rebound resilience. The material further preferably has both of a unit represented by chemical formula (4) and a unit represented by chemical formula (8) particularly from the viewpoint of easily controlling polishing property.

Formula (4)

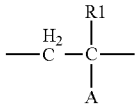

In the chemical formula (4), A represents any of the following chemical formulae (5), (6) and (7). When the resin of the hollow-shaped resin particle has multiple units each represented by formulae (4), the resin may have at least one type of A selected from the following chemical formulae (5), (6) and (7). R1 represents a hydrogen atom or an alkyl group having 1 to 4 carbon atoms.

Formula (5)

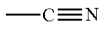

Formula (6)

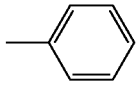

Formula (7)

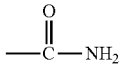

Formula (8)

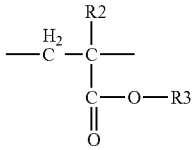

In the chemical formula (8), R2 represents a hydrogen atom or an alkyl group having 1 to 4 carbon atoms, and R3 represents a hydrogen atom or an alkyl group having 1 to 10 carbon atoms.

Another method can be a method using a thermally expandable microcapsule including an encapsulation substance in a particle, in which the encapsulation substance is expended by heat application to provide the hollow-shaped resin particle. Such a method is a method including producing an electro-conductive resin composition in which a thermally expandable microcapsule is dispersed in the binder, covering the electro-conductive substrate with the composition, and subjecting the resultant to drying, curing, crosslinking or the like. In the case of the method, the encapsulation substance can be expanded by heat in drying, curing or crosslinking of the binder for use in the pre-covering layer, to form the hollow-shaped resin particle. The temperature condition here can be controlled to thereby control the particle size.

When the thermally expandable microcapsule is used, a thermoplastic resin is needed to be used as the binder. Examples of the thermoplastic resin include the following: an acrylonitrile resin, a vinyl chloride resin, a vinylidene chloride resin, a methacrylic acid resin, a styrene resin, a butadiene resin, a urethane resin, an amide resin, a methacrylonitrile resin, an acrylic acid resin, an acrylic acid ester resin and a methacrylic acid ester resin. In particular, a thermoplastic resin made of at least one selected from an acrylonitrile resin, a vinylidene chloride resin and a methacrylonitrile resin each being low in gas permeability and exhibiting a high rebound resilience is more preferably used from the viewpoint of controlling the distribution of the hardness described below. Such thermoplastic resins can be used singly or in combinations of two or more types thereof.

Any monomers of such thermoplastic resins may be copolymerized to provide a copolymer.

The substance to be encapsulated in the thermally expandable microcapsule can be one which is gasified and expended at a temperature equal to or less than the softening point of the thermoplastic resin, and examples thereof include the following: low-boiling point liquids such as propane, propylene, butene, n-butane, isobutane, n-pentane and isopentane, and high boiling point liquids such as n-hexane, isohexane, n-heptane, n-octane, isooctane, n-decane and isodecane.

The thermally expandable microcapsule can be produced by a known production method such as a suspension polymerization method, an interfacial polymerization method, an interfacial settling method or a liquid drying method. An example of the suspension polymerization method can be a method including mixing a polymerizable monomer, the substance included in the thermally expandable microcapsule, and a polymerization initiator, dispersing the mixture in an aqueous medium containing a surfactant and a dispersion stabilizer, and thereafter subjecting the resultant to suspension polymerization. Herein, a compound having a reactive group with a functional group of the polymerizable monomer, and an organic filler can also be added.

Examples of the polymerizable monomer can include the following: acrylonitrile, methacrylonitrile, α-chloroacrylonitrile, α-ethoxyacrylonitrile, fumaronitrile, acrylic acid, methacrylic acid, itaconic acid, maleic acid, fumaric acid, citraconic acid, vinylidene chloride, vinyl acetate, acrylic acid esters (methyl acrylate, ethyl acrylate, n-butyl acrylate, isobutyl acrylate, t-butyl acrylate, isobornyl acrylate, cyclohexyl acrylate, benzyl acrylate), methacrylic acid esters (methyl methacrylate, ethyl methacrylate, n-butyl methacrylate, isobutyl methacrylate, t-butyl methacrylate, isobornyl methacrylate, cyclohexyl methacrylate, benzyl methacrylate), a styrene-based monomer, acrylamide, substituted acrylamide, methacrylamide, substituted methacrylamide, butadiene, ε-caprolactam, polyether and isocyanate. Such polymerizable monomers can be used singly or in combinations of two or more types thereof.

The polymerization initiator, but not particularly limited, can be an initiator soluble in the polymerizable monomer, and known peroxide initiator and azo initiator can be used. In particular, an azo initiator can be used. Examples of the azo initiator include the following: 2,2'-azobisisobutyronitrile, 1,1'-azobiscyclohexane-1-carbonitrile and 2,2'-azobis-4-methoxy-2,4-dimethylvaleronitrile. In particular, 2,2'-azobisisobutyronitrile can be adopted. When the polymerization initiator is used, the amount thereof to be used can be 0.01 parts by mass or more and 5 parts by mass or less based on 100 parts by mass of the polymerizable monomer.

As the surfactant, an anionic surfactant, a cationic surfactant, a nonionic surfactant, an amphoteric surfactant or a polymer type dispersant can be used. The amount of the surfactant to be used can be 0.01 parts by mass or more and 10 parts by mass or less based on 100 parts by mass of the polymerizable monomer. Examples of the dispersion stabilizer include the following: organic fine particles (polystyrene fine particle, polymethyl methacrylate fine particle, polyacrylic acid fine particle and polyepoxide fine particle), silica (colloidal silica), calcium carbonate, calcium phosphate, aluminum hydroxide, barium carbonate and magnesium hydroxide. The amount of the dispersion stabilizer to be used can be 0.01 parts by mass or more and 20 parts by mass or less based on 100 parts by mass of the polymerizable monomer.

Suspension polymerization can be performed using a pressure resistant container under a sealed condition. In addition, a polymerizable raw material may be suspended by a dispersing machine or the like and then transferred into a pressure resistant container for suspension polymerization, or may be suspended in a pressure resistant container. The polymerization temperature can be 50° C. or more and 120° C. or less. Such polymerization may be performed at atmosphere pressure, or can be performed under pressure (under pressure where 0.1 MPa or more and 1 MPa or less is added to atmosphere pressure) in order not to vaporize the substance encapsulated in the thermally expandable microcapsule. After the completion of polymerization, solid-liquid separation and washing may be performed by centrifugation and filtration. When solid-liquid separation and washing are performed, drying and grinding may be then performed at a temperature equal to or less than the softening temperature of the resin forming the thermally expandable microcapsule. Such drying and grinding can be performed by a known method, and a flash dryer, a fair wind dryer and a nauta mixer can be used. Such drying and grinding can also be simultaneously performed by a grinding dryer. The surfactant and the dispersion stabilizer can be removed by repeating washing and filtration after production.

In order that S described above is within the range of the expression (1), the particle size distribution of the microcapsule can be narrower by a classification operation or the like. Specifically, a microcapsule can be used where the variation coefficient obtained by dividing the standard deviation σ by the volume average particle size d, obtained by particle size distribution measurement, is 0.20 or less. The classification method is not particularly limited, and a known procedure can be used.

In order that D described above is within the range of the expression (2), a procedure can be adopted where a master batch in which the microcapsule is dispersed in a resin is used and the master batch is added to and mixed with a binder resin, because the microcapsule is more uniformly dispersed in the resin. The resin here used in the master batch is preferably a polymer whose type is the same as the binder resin to which the master batch is to be added, and is more preferably a polymer at a grade where the viscosity and the polarity of such a polymer are closer to those of the binder resin. The reason is because, as compatibility between the resin of the master batch and the binder resin to be added thereto are higher, the microcapsule is more uniformly dispersed. A known procedure where the microcapsule and the resin are kneaded in a temperature range not causing any foaming of the microcapsule can be used for production of the master batch.

[Method for Forming Pre-Covering Layer]

Subsequently, the method for forming the pre-covering layer is described. Examples of the method for forming the pre-covering layer include a method including forming a layer of the electro-conductive resin composition on the electro-conductive substrate by a coating method such as electrostatic spray coating, dip coating or roll coating, and curing the layer by drying, heating, crosslinking or the like. Examples also include a method including forming the electro-conductive resin composition into a film having a predetermined thickness, curing the film to provide a sheet-shaped or tube-shaped layer, and subjecting the layer to adhesion to or covering of the electro-conductive substrate. Examples further include a method including loading the electro-conductive resin composition in a mold where the electro-conductive substrate is placed, and curing the electro-conductive resin composition to form the pre-covering layer. In particular, when the binder is rubber, the pre-covering layer can be produced by using an extruder provided with a crosshead to integrally extrude the electroconductive substrate and an unvulcanized rubber composition. The crosshead is an extrusion mold for use in formation of a covering layer of an electric wire or a wire, the extrusion mold being used with being placed at the cylinder tip of the extruder. Thereafter, drying, curing, crosslink or the like is made, and thereafter the surface of the pre-covering layer is polished, thereby deleting a part of the hollow-shaped resin particle to provide a bowl shape. As the polishing method, a cylinder polishing method or a tape-polishing method can be used. Examples of a cylinder polishing machine include a traverse type NC cylinder polishing machine and a plunge cut type NC cylinder polishing machine.

(a) Case where Thickness of Pre-Covering Layer is 5 Times or Less Average Particle Size of Hollow-Shaped Resin Particle When the thickness of the pre-covering layer is 5 times or less the average particle size of the hollow-shaped resin particle, the convex portion derived from the hollow-shaped resin particle is often formed on the pre-covering layer surface. In such a case, a part of the convex portion of the hollow-shaped resin particle can be deleted to provide a bowl shape, thereby forming a concave and convex shape based on an opening of the bowl-shaped resin particle.

In the case, a tape-polishing system relatively low in the pressure to be applied to the pre-covering layer in polishing can be used. As one example, the ranges which can be adopted with respect to the polishing conditions of the pre-covering layer in use of the tape-polishing system are represented below. The polishing tape is obtained by dispersing a polishing abrasive grain in a resin, and coating a sheet-shaped substrate with such a dispersion.

Examples of the polishing abrasive grain can include aluminum oxide, chromium oxide, iron oxide, diamond, cerium oxide, corundum, silicon nitride, silicon carbide, molybdenum carbide, tungsten carbide, titanium carbide and silicon oxide. The average particle size of the polishing abrasive grain is preferably 0.01 μm or more and 50 μm or less, more preferably 1 μm or more and 30 μm or less. The average particle size of the polishing abrasive grain here means the median diameter D50 measured by a centrifugal sedimentation method. The count of yarn of the polishing tape having the polishing abrasive grain which can be adopted is preferably in the range of 500 or more and 20000 or less, more preferably 1000 or more and 10000 or less. Specific examples of the polishing tape include the following: "MAXIMA LAP" and "MAXIMA T type" (trade names, manufactured by Nippon Ref-lite Industry), "Lapika" (trade name, manufactured by KOVAX Corporation), "Microfinishing Film" and "Lapping Film" (trade names, manufactured by Sumitomo 3M Ltd. (new company name: 3M Japan Ltd.)), Mirror Film and Lapping Film (trade names, manufactured by Sankyo-Rikagaku Co., Ltd.) and Mipox (trade name, manufactured by Mipox Corporation (former company name: Nihon Micro Coating Co., Ltd.)).

The feeding speed of the polishing tape is preferably 10 mm/min or more and 500 mm/min or less, more preferably 50 mm/min or more and 300 mm/min or less. The pressing pressure of the polishing tape onto the pre-covering layer is preferably 0.01 MPa or more and 0.4 MPa or less, more preferably 0.1 MPa or more and 0.3 MPa or less. In order to control the pressing pressure, the pre-covering layer may abut with a backup roller with the polishing tape interposed therebetween. In order to provide a desired shape, a polishing treatment may be performed several times. The rotation speed is preferably set to 10 rpm or more and 1000 rpm or less, more preferably 50 rpm or more and 800 rpm or less. Such conditions can allow a concave and convex shape due to the opening of the bowl-shaped resin particle to be more easily formed on the surface of the pre-covering layer. Even when the thickness of the pre-covering layer is within the above range, a concave and convex shape due to the opening of the bowl-shaped resin particle can be formed according to a method (b) described below.

(b) Case where Thickness of Pre-Covering Layer is More than 5 Times Average Particle Size of Hollow-Shaped Resin Particle When the thickness of the pre-covering layer is more than 5 times the average particle size of the hollow-shaped resin particle, a case may be caused where no convex portion derived from the hollow-shaped resin particle is formed on the pre-covering layer surface. In such a case, the difference in polishing property between the hollow-shaped resin particle and the material of the pre-covering layer can be utilized to form a concave and convex shape due to the opening of the bowl-shaped resin particle. The hollow-shaped resin particle encapsulates gas therein and therefore has a high rebound resilience. On the contrary, a rubber or resin relatively low in rebound resilience and small in elongation is selected as the binder of the pre-covering layer. Thus, a state can be achieved where the pre-covering layer is easily polished and the hollow-shaped resin particle is hardly polished. The pre-covering layer in such a state can be polished, thereby allowing the hollow-shaped resin particle not to be polished in the same state as in the pre-covering layer, to provide a bowl shape where a part of the hollow-shaped resin particle is deleted. Thus, a concave and convex shape due to the opening of the bowl-shaped resin particle can be formed on the surface of the pre-covering layer. Such a method is a method for forming a concave and convex shape by use of the difference in polishing property between the hollow-shaped resin particle and the material of the pre-covering layer, and therefore the material (binder) for use in the pre-covering layer is preferably rubber. In particular, acrylonitrile/butadiene rubber, styrene/butadiene rubber or butadiene rubber is particularly preferably used from the viewpoint of being low in rebound resilience and small in elongation.

[Polishing Method]

A cylinder polishing method and a tape polishing method can be used for the polishing method for use in the condition (b), but such methods are needed to remarkably draw out the difference in polishing property between the materials, and therefore a polishing method where polishing is made at a higher speed is preferably used. A cylinder polishing method is more preferably used from such a viewpoint. In particular, a plunge cut type cylinder polishing method is further preferably used from the viewpoint of being capable of simultaneously polishing the pre-covering layer in the longitudinal direction thereof to result in a reduction in polishing time. A spark-out step (polishing step at a penetration rate of 0 mm/min) conventionally performed from the viewpoint of providing a uniform polished surface can be performed as briefly as possible, or such a step cannot be performed.

As one example, the rotation speed of a plunge cut type cylindrical abrasive stone is 1000 rpm or more and 4000 rpm or less, or is particularly preferably 2000 rpm or more and 4000 rpm or less. The penetration rate to the pre-covering layer is 5 mm/min or more and 30 mm/min or less, or particularly more preferably 10 mm/min or more and 30 mm/min or less. A step of conditioning the polished surface may be included at the end of the penetration step, and can be performed at a penetration rate of 0.1 mm/min or more and 0.2 mm/min or less for 2 seconds or less. The spark-out step (polishing step at a penetration rate of 0 mm/min) can be performed for 3 seconds or less. The rotation speed is preferably set to 50 rpm or more and 500 rpm or less, further preferably 200 rpm or more. Such conditions can be set to thereby more easily provide concave and convex formation due to the opening of the bowl-shaped resin particle on the surface of the pre-covering layer.

Herein, the pre-covering layer subjected to a polishing treatment in the following description is simply referred to as "covering layer".

[Curing of Surface]

Figure 3A:
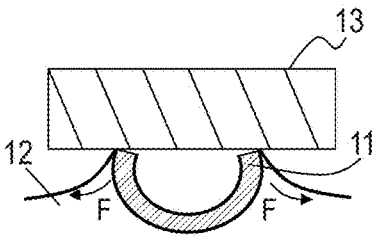
FIG. 3A and FIG. 3B include cross-sectional views each illustrating one example of a deformed state of the electrophotographic roller according to the present disclosure, in abutment with a glass plate.
Figure 3B:
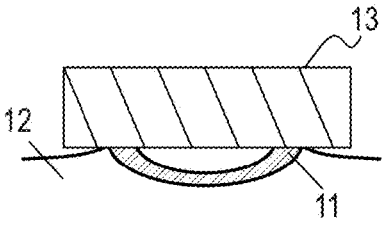

When the hardness of the binder around the bowl-shaped resin particle is low, the edge portion is considerably deformed in a direction of F in FIG. 3A, and therefore the area of each of the contact portions of the electrophotographic roller with the photosensitive member may be increased, thereby linking the contact portions of the edge portion with the photosensitive member in an dependent manner, to result in a significant increase in the area of each of the contact portions, as illustrated in FIG. 3B. Such an increase in the contact surface area remarkably increases contamination, and therefore the binder resin on the surface is needed to be cured to such an extent that the contact portions of the edge portion with the photosensitive member are each independent.

As the curing method, a method where an electro-conductive resin layer high in hardness is provided on a surface to be cured, a method, while the detail is described below, where the binder is cured by electron beam irradiation, a method where the binder is cured by heating at a high temperature of 180° C. or more in an air atmosphere, or the like can be used. Among such methods, a method where heating is made at a high temperature of 180° C. or more in an air atmosphere can be adopted because of effectively suppressing an increase in the area of each of the contact portions of the electrophotographic roller with the photosensitive member surface due to deformation of the bowl-shaped resin particle. In such a case, as the binder, styrene/butadiene rubber (SBR), butyl rubber, acrylonitrile/butadiene rubber (NBR), chloroprene rubber (CR) or butadiene rubber (BR) which has a double bond in the molecule and which is high in heat resistance can be used from the viewpoint of enhancing the effect of crosslinking of an oxide.

(Electron Beam Irradiation)

Figure 6:
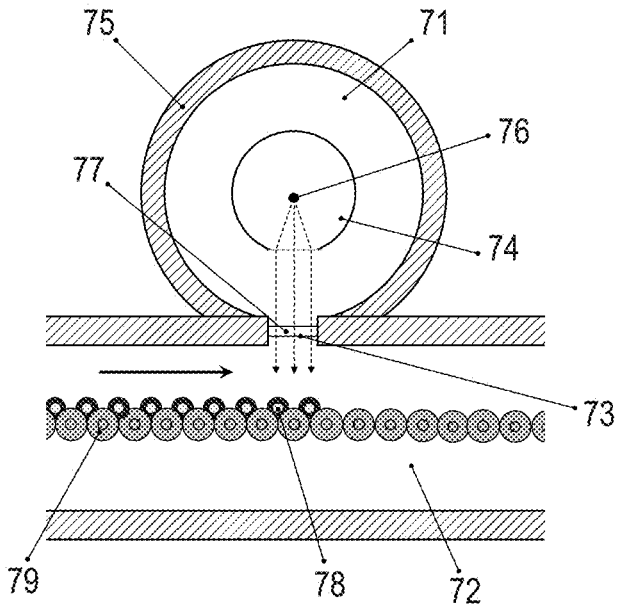
FIG. 6 is an illustration view of an electron beam irradiation apparatus for use in production of the electrophotographic roller according to the present disclosure.

First, FIG. 6 illustrates a schematic view of a common electron beam irradiation apparatus. The electron beam irradiation apparatus illustrated is an apparatus that can irradiate the surface of the electrophotographic roller with electron beam while the electrophotographic roller is rotated, and includes an electron beam generation portion 71, an irradiation chamber 72 and an irradiation port 73.

The electron beam generation portion 71 includes an acceleration tube 75 that accelerates electron beam generated in an electron source (electron gun) 74 in a vacuum space (acceleration space). The interior of the electron beam generation portion is maintained in vacuum at $10^{-3}$ to $10^{-6}$ Pa by a vacuum pump or the like not illustrated, in order to prevent an electron from colliding with a gas molecule and thus losing energy.

When a filament 76 is subjected to application of an electrical current by a power source not illustrated, and is heated, the filament 76 emits a thermal electron and the thermal electron is effectively taken out as electron beam. The electron beam is accelerated by an acceleration voltage in the acceleration space in the acceleration tube 75 and thereafter penetrates through an irradiation port foil 77, and a roller member 78 being conveyed in the irradiation chamber 72 located below the irradiation port 73 is irradiated with the electron beam When the roller member 78 is irradiated with the electron beam as in the present embodiment, the interior of the irradiation chamber 72 is in a nitrogen atmosphere. The roller member 78 is rotated by a roller rotation member 79 and moves in the irradiation chamber by a conveyance unit from the left to the right in FIG. 6. Herein, a lead shield or a shield of stainless steel, not illustrated, is provided around the electron beam generation portion 71 and the irradiation chamber 72 so as not to cause X-ray secondarily generated in electron beam irradiation to be leaked outside.

The irradiation port foil 77 is made of metal foil to partition the vacuum atmosphere in the electron beam generation portion and the nitrogen atmosphere in the irradiation chamber, and electron beam is taken out into the irradiation chamber via the irradiation port foil 77. Accordingly, the irradiation port foil 77 provided at the boundary between the electron beam generation portion 71 and the irradiation chamber 72 can have no pinhole, can have a mechanical strength which enables the vacuum atmosphere in the electron beam generation portion to be sufficiently maintained, and can allow the electron beam to penetrate. Therefore, the irradiation port foil 77 can be made of a metal low in specific gravity and thin in thickness, and aluminum foil, titanium foil, beryllium foil or a carbon film is usually used. For example, thin foil having a thickness of about 5 μm or more and 30 μm or less is used. The curing treatment conditions by electron beam are determined by the acceleration voltage and the radiation dose of the electron beam. The acceleration voltage has an effect on the curing treatment depth, and the acceleration voltage condition in the present disclosure is preferably in the range from 40 to 300 kV which is a low energy range. In the case of an acceleration voltage of 40 kV or more, a treatment region having a thickness sufficient for achieving the effect of the present disclosure can be obtained. A further preferable acceleration voltage is in the range from 70 to 150 V.

The radiation dose of electron beam in electron beam irradiation is defined according to the following expression:

$$D=(K\cdot I)/V$$

wherein D represents the radiation dose (kGy), K represents the apparatus coefficient, I represents the electronic current (mA) and V represents the treatment speed (m/min). The apparatus coefficient K is a constant number representing the efficiency of an individual apparatus and is an index representing performance of such an apparatus. The apparatus coefficient K can be determined by measuring the radiation dose in a constant acceleration voltage condition with the electronic current and the treatment speed being varied. Measurement of the radiation dose of electron beam is performed by attaching a radiation dose measurement film onto the surface of the electrophotographic roller, irradiating the surface with electron beam, and measuring the radiation dose of the radiation dose measurement film by a film radiation dosimeter. The radiation dose measurement film used is FWT-60 and the film radiation dosimeter used is FWT-92 Model (both manufactured by Far West Technology, Inc.).

Figure 7:
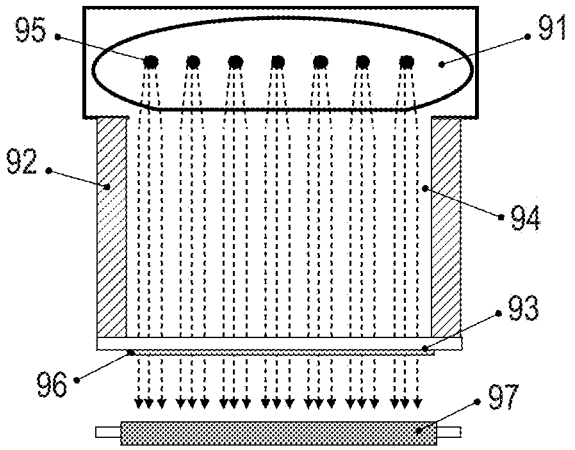
FIG. 7 is an illustration view of an area-type electron beam irradiation source for use in production of the electrophotographic roller according to the present disclosure.

Next, the area-type electron beam irradiation source is described in detail. The area-type electron beam irradiation source includes an electron gun 91, a container 92 of an electron beam generation portion, and an irradiation port 93, as illustrated in FIG. 7. The area-type electron beam irradiation source is an apparatus that accelerates electron beam emitted from the electron gun 91, in an acceleration tube 94 in a vacuum space (acceleration space), to irradiate a predetermined area through the irradiation port 93 in a linear manner.

The electron gun 91 includes multiple filaments 95 for emission of electron beam. The electron beam emitted from the multiple filaments 95 is accelerated in the acceleration tube 94 in the vacuum space (acceleration space) and is output towards the irradiation port 93. A vacuum pump not illustrated is connected to a side portion of the container 92 of an electron beam generation portion, and the interior of the electron beam generation portion and the acceleration tube 94 are kept in vacuum at $10^{-3}$ to $10^{-6}$ Pa in order to prevent an electron from colliding with a gas molecule and thus losing energy.

Linear electron beam emitted from the multiple filaments 95 penetrates through an irradiation window 96 provided on the irradiation port 93, and the surface of an electrophotographic roller 97 disposed outside of the area-type electron beam irradiation source is irradiated with such linear electron beam. The irradiation window 96 of electron beam is formed by, for example, titanium foil or beryllium foil having a thickness of about several μm to 10 μm.

<Electrophotographic Apparatus>

Figure 8:
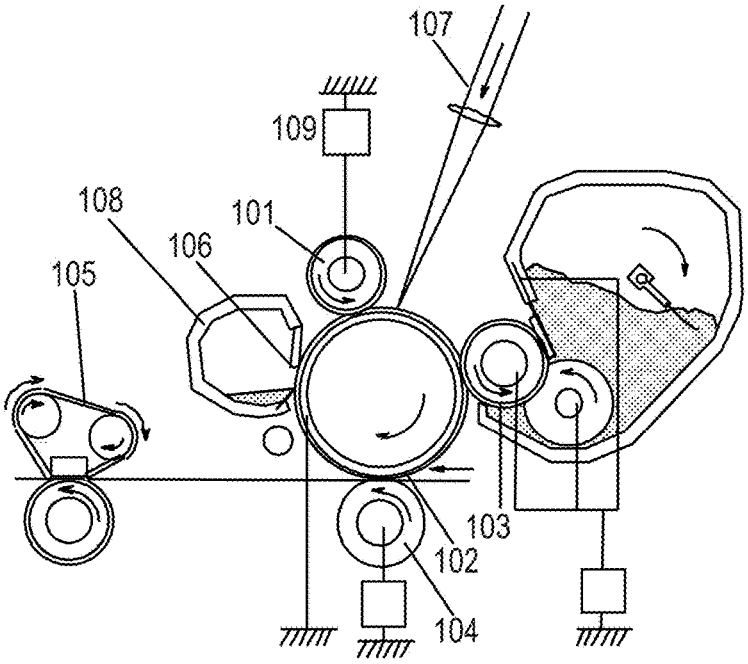
FIG. 8 is a schematic cross-sectional view representing one example of the electrophotographic apparatus according to the present disclosure.

The schematic configuration of an example of an electrophotographic apparatus is illustrated in FIG. 8. This electrophotographic apparatus includes an electrophotographic photosensitive member, a charging apparatus for charging the electrophotographic photosensitive member, a latent image-forming apparatus for exposing the electrophotographic photosensitive member to light to form an electrostatic latent image, a developing apparatus for developing the electrostatic latent image as a toner image, a transferring apparatus for transferring the toner image to a transfer material, a cleaning apparatus for collecting transfer residual toner on the electrophotographic photosensitive member, a fixing apparatus for fixing the toner image on the transfer material, and the like. An electrophotographic roller according to the present disclosure can be used as at least either of electrophotographic rollers included in the charging apparatus and the transferring apparatus of this electrophotographic apparatus.

An electrophotographic photosensitive member 102 is a rotational drum type having a photosensitive layer on an electro-conductive substrate. The electrophotographic photosensitive member 102 is rotated at a predetermined circumferential speed (process speed) in the arrow direction. A charging apparatus has a contact charging roller 101 that is contacted and disposed by allowing to abut with the electrophotographic photosensitive member 102 at a predetermined pressing force. The charging roller 101 conducts following rotation, which is rotation following the rotation of the electrophotographic photosensitive member 102, and charges the electrophotographic photosensitive member 102 at a predetermined electric potential by applying a predetermined direct current voltage from a charging power supply 109. An exposure apparatus such as a laser beam scanner is used for a latent image-forming apparatus (not illustrated) for forming an electrostatic latent image on the electrophotographic photosensitive member 102. An electrostatic latent image is formed by irradiating the uniformly charged electrophotographic photosensitive member 102 with exposure light 107 corresponding to image information.

A developing apparatus has a developing sleeve or a developing roller 103 that is disposed close to the electrophotographic photosensitive member 102 or contacted therewith. The developing apparatus develops an electrostatic latent image by reversal development to form a toner image with toner subjected to electrostatic treatment to have the same polarity as the charged polarity of the electrophotographic photosensitive member 102. A transferring apparatus has a contact transferring roller 104. The toner image is transferred from the electrophotographic photosensitive member 102 to a transfer material such as plain paper. The transfer material is conveyed by a paper-feeding system having a conveying member.

A cleaning apparatus has a blade-shaped cleaning member 106 and a collection container 108, and mechanically scrapes away transfer residual toner remaining on the electrophotographic photosensitive member 102 and collects the toner after the developed toner image is transferred to the transfer material. Here, a cleaning apparatus can be omitted by adopting a method for simultaneously conducting development and cleaning, which allows the developing apparatus to collect transfer residual toner. The toner image transferred to the transfer material is fixed on the transfer material by passing through between a fixing belt 105 heated by an unillustrated heating apparatus and a roller opposed to the fixing belt.

<Process Cartridge>

Figure 9:
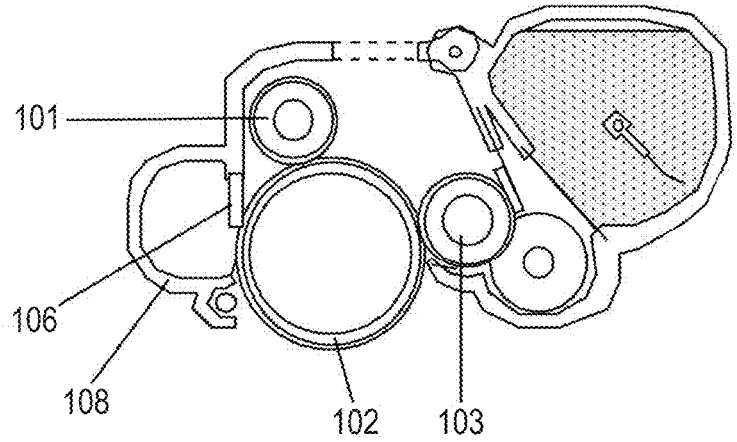
FIG. 9 is a schematic cross-sectional view representing one example of the process cartridge according to the present disclosure.

The schematic configuration of an example of a process cartridge according to an aspect of the present disclosure is illustrated in FIG. 9. For example, an electrophotographic photosensitive member 102, a charging roller 101 disposed so as to enable charging the electrophotographic photosensitive member 102, a developing roller 103 and a cleaning member 106, a collection container 108 and the like are integrated into this process cartridge, which is configured to be detachable from the main body of an electrophotographic apparatus. An electrophotographic roller according to an aspect of the present disclosure can be used, for example, as the charging roller 101 of this process cartridge.

According to an aspect of the present disclosure, an electrophotographic roller that is further improved in driven rotatability by a photosensitive member drum can be obtained.

According to another aspect of the present disclosure, a process cartridge and an electrophotographic apparatus that serve to form a high-definition electrophotographic image can be obtained.

EXAMPLES

The present disclosure will be described still more specifically by specific Production Examples and Examples below.

The numbers of parts and % in the following Examples and Comparative Examples are all based on mass, unless otherwise specified.

Production Example 1: Production of Resin Particle No. 1

An aqueous mixed solution including 4000 parts by mass of ion-exchanged water, 9 parts by mass of colloidal silica and 0.15 parts by mass of polyvinylpyrrolidone as dispersion stabilizers was prepared. Subsequently, an oily mixed solution including 50 parts by mass of acrylonitrile, 45 parts by mass of methacrylonitrile and 5 parts by mass of methyl acrylate as polymerization monomers; 12.5 parts by mass of normal hexane as an included substance; and 0.75 parts by mass of dicumyl peroxide as a polymerization initiator was prepared. A dispersion was prepared by adding this oily mixed solution to the aqueous mixed solution and further adding 0.4 parts by mass of sodium hydroxide.

The reaction product was prepared by stirring and mixing the obtained dispersion for 3 minutes using a homogenizer, charging a polymerization reaction vessel replaced with nitrogen gas with the dispersion, and reacting the dispersion at 60° C. for 20 hours with stirring at 450 rpm. A resin particle was produced by repeating the filtration and washing of the obtained reaction product and then drying at 80° C. for 5 hours. A resin particle No. 1 was obtained by crushing and classifying this resin particle by a sonic wave classifier. The physical properties of the resin particle No. 1 are shown in Table 1.

A method for measuring the particle size distribution will be mentioned below.

Production Example 2 and 3: Production of Resin Particle No. 2 and No. 3

Resin particles No. 2 and No. 3 were obtained by classifying coarse powder and fine powder of the resin particle No. 1 obtained by Production Example 1 by an elbow-jet classifier EJ-PURO (trade name, manufactured by Nittetsu Mining Co., Ltd.). The physical properties are shown in Table 1.

Production Example 4: Production of Resin Particle No. 4

A resin particle No. 4 was obtained by producing and classifying the resin particle by the same method as in Production Example 1, except that the number of stirring revolutions at the time of polymerization was changed into 600 rpm. The physical properties are shown in Table 1.

Production Example 5: Production of Resin Particle No. 5

A resin particle No. 5 was obtained by classifying coarse powder and fine powder of the resin particle No. 4 obtained by Production Example 4 by an elbow-jet classifier EJ-PURO (trade name, manufactured by Nittetsu Mining Co., Ltd.). The physical properties are shown in Table 1.

Production Example 6: Production of Resin Particle No. 6

A resin particle No. 6 was obtained by producing and classifying the resin particle by the same method as in Production Example 1, except that the amount of colloidal silica was changed into 4.5 parts by mass. The physical properties are shown in Table 1.

Production Example 7: Production of Resin Particle No. 7

A resin particle No. 7 were obtained by classifying coarse powder and fine powder of the resin particle No. 6 obtained by Production Example 6 by an elbow-jet classifier EJ-PURO (trade name, manufactured by Nittetsu Mining Co., Ltd.). The physical properties are shown in Table 1.

Production Example 8: Production of Resin Particle No. 8

A resin particle No. 8 was obtained by producing and classifying the resin particle by the same method as in Production Example 1, except that the amount of colloidal silica was changed into 4.5 parts by mass and the number of stirring revolutions at the time of polymerization was changed into 300 rpm. The physical properties are shown in Table 1.

Production Example 9: Production of Resin Particle No. 9

A resin particle No. 9 was obtained by classifying coarse powder and fine powder of the resin particle No. 8 obtained by Production Example 8 by an elbow-jet classifier EJ-PURO (trade name, manufactured by Nittetsu Mining Co., Ltd.). The physical properties are shown in Table 1.

<Measurement of the Volume Average Particle Size of Resin Particle>

The volume average particle sizes of the resin particles No. 1 to No. 9 were measured by a laser diffraction particle size distribution meter (trade name: particle size distribution meter Coulter LS-230, manufactured by Coulter K.K.).

A water system module was used, and pure water was used as a measurement solvent for measurement. The inside of the measurement system of the particle size distribution meter was washed with pure water for around 5 minutes, 10 mg to 25 mg of sodium sulfite was added as an antifoaming agent, followed by performing background function. Next, three drops to four drops of surfactant was added to 50 ml of pure water, and 1 mg to 25 mg of a measurement sample was further added. The solution in which the sample was suspended was subjected to dispersion treatment by an ultrasonic disperser for 1 minute to 3 minutes to prepare a test sample liquid. Measurement was performed by gradually adding the test sample liquid into the measurement system of the measuring apparatus and adjusting the concentration of the test sample in the measurement system so that the PIDS on the screen of the apparatus was 45% or more to 55% or less. The volume average particle size was calculated from the obtained volume distribution. The obtained results on the volume average particle size are shown in Table 1 with the standard deviations and the coefficients of variation in the particle size distributions.

TABLE 1

| Production Example | Resin Particle No. | Amount of colloidal silica [part by mass] | The number of stirring revolutions [rpm] | Volume average particle diameter d [μm] | Standard deviation σ [μm] | Coefficient of variation d/σ |
|---|---|---|---|---|---|---|
| 1 | 1 | 9 | 450 | 10.3 | 3.1 | 0.30 |
| 2 | 2 | 9 | 450 | 9.6 | 1.8 | 0.19 |
| 3 | 3 | 9 | 450 | 9.3 | 1.2 | 0.13 |
| 4 | 4 | 9 | 600 | 5.5 | 2.8 | 0.51 |
| 5 | 5 | 9 | 600 | 5.7 | 1.1 | 0.19 |
| 6 | 6 | 4.5 | 450 | 19.6 | 5.2 | 0.27 |
| 7 | 7 | 4.5 | 450 | 19.9 | 3.4 | 0.17 |
| 8 | 8 | 4.5 | 300 | 40.5 | 9.1 | 0.22 |
| 9 | 9 | 4.5 | 300 | 39.2 | 5.6 | 0.14 |

Production Example 10: Production of Resin Particle-Containing Masterbatch No. 1

First, 100 parts by mass of the resin particle No. 2 was added to 100 parts by mass of acrylonitrile-butadiene rubber (NBR) (trade name: N230SV, produced by JSR Corporation), and the mixture was kneaded by an airtight mixer the temperature of which was adjusted to 30° C. for 10 minutes. A resin particle-containing masterbatch No. 1 was obtained by adjusting kneading conditions properly so that the resin particle No. 2 was in the range of 80° C. or less in which the resin particle No. 2 does not start foaming as to kneading.

Production Examples 11 to 20: Production of Resin Particles-Containing Masterbatches No. 2 to 11

Resin particles-containing masterbatches No. 2 to No. 11 were obtained by the same method as in Production Example 10, except that any of resin particles, the polymer types and the polymer grades was changed as in Table 2.

TABLE 2

| Production Example | Resin particle-containing masterbatch No. | Resin Particle No. | Polymer type and grade |
|---|---|---|---|
| 10 | 1 | 2 | NBR N230SV(JSR Corporation) |
| 11 | 2 | 3 | NBR N230SV(JSR Corporation) |
| 12 | 3 | 3 | NBR N240S(JSR Corporation) |
| 13 | 4 | 5 | NBR N230SV(JSR Corporation) |
| 14 | 5 | 7 | NBR N230SV(JSR Corporation) |
| 15 | 6 | 2 | SBR TUFDENE 2003 (Asahi Kasei Corporation) |
| 16 | 7 | 2 | BR BR01(JSR Corporation) |
| 17 | 8 | 1 | NBR N230SV(JSR Corporation) |
| 18 | 9 | 8 | NBR N230SV(JSR Corporation) |
| 19 | 10 | 9 | NBR N230SV(JSR Corporation) |
| 20 | 11 | 2 | EPDM EP33(JSR Corporation) |

Production Examples 21: Production of Electro-Conductive Resin Composition No. 1

Other materials shown in the columns of components (1) in Table 3 were added to 100 parts by mass of acrylonitrile-butadiene rubber (NBR) (trade name: N230SV, produced by JSR Corporation), and the mixture was kneaded by the airtight mixer the temperature of which was adjusted to 50° C. for 15 minutes. The materials shown in the columns of components (2) in Table 3 were added to this. Subsequently, the mixture was kneaded for 10 minutes by a 2-roll machine cooled to a temperature of 25° C. to obtain an electro-conductive resin composition No. 1.

TABLE 3

| | Material | Amount of material used (part by mass) |
|---|---|---|
| Component (1) | Acrylonitrile-butadiene rubber (NBR) (trade name: N230SV, produced by JSR Corporation) | 100 |
| | Carbon black (trade name: TOKA BLACK #7360SB, produced by TOKAI CARBON CO., LTD.) | 48 |
| | Zinc oxide (trade name: Zinc Flower Grade 2, produced by SAKAI CHEMICAL INDUSTRY CO., LTD.) | 5 |
| | Zinc stearate (trade name: SZ-2000, produced by SAKAI CHEMICAL INDUSTRY CO., LTD.) | 1 |
| | Calcium carbonate (trade name: NANOX#30, produced by MARUO CALCIUM CO., LTD.) | 20 |
| Component (2) | Resin particle No. 1 | 12 |
| | Sulfur (vulcanizing agent) | 1.2 |
| | Vulcanization accelerator Tetra-benzylthiuram disulfide (TBzTD) (trade name: PERKACITTBzTD, produced by Performance Additives) | 4.5 |

Production Examples 22 to 36: Production of Electro-Conductive Resin Compositions No. 2 to No. 16

Electro-conductive resin compositions No. 2 to No. 16 were obtained in the same manner as in Production Example 21, except that the resin particle, the number of parts added, and the form at the time of mixture were changed as shown in Table 5 in Production Example 21 of the electro-conductive resin composition No. 1.

Production Example 37: Production of Electro-Conductive Resin Composition No. 17

Other materials shown in the columns of components (1) in Table 4 were added to 100 parts by mass of styrene-butadiene rubber (SBR) (trade name: TUFDENE 2003, produced by Asahi Kasei Chemicals K. K.), and the mixture was kneaded by the airtight mixer having a temperature adjusted to 80° C. for 15 minutes. The materials shown in the columns of components (2) in Table 4 were added to this. Subsequently, the mixture was kneaded for 10 minutes by a 2-roll machine cooled to a temperature of 25° C. to obtain an electro-conductive resin composition No. 17.

TABLE 4

| | Material | Amount of material used (part by mass) |
|---|---|---|
| Component (1) | Styrene-butadiene rubber (SBR) (trade name: TUFDENE 2003, produced byAsahi Kasei Corporation) | 100 |
| | Carbon black (trade name: KETJENBLACK EC600JD, produced by Lion K.K. (New company name: LION SPECIALTY CHEMICALS CO., LTD.)) | 8 |
| | Carbon black (trade name: SEAST 5, produced by TOKAI CARBON CO., LTD.) | 40 |
| | Zinc oxide (trade name: Zinc Flower Grade 2, produced by SAKAI CHEMICAL INDUSTRY CO., LTD.) | 5 |
| | Zinc stearate (trade name: SZ-2000, produced by SAKAI CHEMICAL INDUSTRY CO., LTD.) | 1 |
| | Calcium carbonate (trade name: NANOX #30, produced by MARUO CALCIUM CO., LTD.) | 15 |

TABLE 4-continued

| | Material | Amount of material used (part by mass) |
|---|---|---|
| Component (2) | Resin particle-containing masterbatch No. 6 | 24 (12 as resin particle No. 2) |
| | Sulfur (vulcanizing agent) | 1 |
| | Dibenzothiazyl disulfide (DM) (trade name: Nocceler DM, produced by OUCHI SHINKO CHEMICAL INDUSTRIAL CO., LTD., vulcanization accelerator) | 1 |
| | Tetramethylthiuram monosulfide (trade name: Nocceler TS, produced by OUCHI SHINKO CHEMICAL INDUSTRIAL CO., LTD., vulcanization accelerator) | 1 |

Production Example 38: Production of Electro-Conductive Resin Composition No. 18

An electro-conductive resin composition No. 18 was obtained in the same manner as in Production Example 21, except that acrylonitrile-butadiene rubber is changed into butadiene rubber (BR) (trade name: JSR BR01, produced by JSR Corporation), carbon black was changed into 30 parts by mass, and the resin particle No. 1 was changed into the resin particle-containing masterbatch No. 7 in Production Example 21 of the electro-conductive resin composition No. 1.

Production Examples 39 to 43: Production of Electro-Conductive Resin Compositions No. 19 to No. 23

Electro-conductive resin compositions No. 19 to No. 23 were obtained in the same manner as in Production Example 21, except that the resin particle, the number of parts added, and the form at the time of mixture were changed as shown in Table 5 in Production Example 21 of the electro-conductive resin composition No. 1.

TABLE 5

| Production Example | Electro-conductive resin composition No. | Binder resin Type | Binder resin Grade | Carbon Black Type | Carbon Black Part by mass | Sulfur Part by mass | Vulcanization accelerator Type | Vulcanization accelerator Part by mass | Resin particle Type (No.) | Resin particle The number of parts [phr] | Resin particle Form at time of mixture |
|---|---|---|---|---|---|---|---|---|---|---|---|
| 21 | 1 | NBR | N230SV | #7360SB | 48 | 1.2 | TBzTD | 4.5 | 1 | 12 | Powder |
| 22 | 2 | | | | | | | | 2 | 12 | Resin particle-containing masterbatch No. 1 |
| 23 | 3 | | | | | | | | 2 | 8 | Resin particle-containing masterbatch No. 1 |
| 24 | 4 | | | | | | | | 2 | 4 | Resin particle-containing masterbatch No. 1 |
| 25 | 5 | | | | | | | | 2 | 2 | Resin particle-containing masterbatch No. 1 |
| 26 | 6 | | | | | | | | 2 | 1 | Resin particle-containing masterbatch No. 1 |
| 27 | 7 | | | | | | | | 2 | 18 | Resin particle-containing masterbatch No. 1 |
| 28 | 8 | | | | | | | | 3 | 12 | Powder |
| 29 | 9 | | | | | | | | 3 | 12 | Resin particle-containing masterbatch No. 2 |
| 30 | 10 | | | | | | | | 3 | 12 | Resin particle-containing masterbatch No. 3 |
| 31 | 11 | | | | | | | | 4 | 12 | Powder |
| 32 | 12 | | | | | | | | 5 | 12 | Powder |
| 33 | 13 | | | | | | | | 5 | 12 | Resin particle-containing masterbatch No. 4 |

TABLE 5-continued

| Production Example | Electro-conductive resin composition No. | Binder resin Type | Binder resin Grade | Carbon Black Type | Carbon Black Part by mass | Sulfur Part by mass | Vulcanization accelerator Type | Vulcanization accelerator Part by mass | Resin particle Type (No.) | Resin particle The number of parts [phr] | Resin particle Form at time of mixture |
|---|---|---|---|---|---|---|---|---|---|---|---|
| 34 | 14 | | | | | | | | 6 | 12 | Powder |
| 35 | 15 | | | | | | | | 7 | 12 | Powder |
| 36 | 16 | | | | | | | | 7 | 12 | Resin particle-containing masterbatch No. 5 |
| 37 | 17 | SBR | TUFDENE 2003 | KETJEN SEAST | 840 | 1 | DMTS | 11 | 2 | 12 | Resin particle-containing masterbatch No. 6 |
| 38 | 18 | BR | BR01 | #7360SB | 30 | 1.2 | TBzTD | 4.5 | 2 | 12 | Resin particle-containing masterbatch No. 7 |
| 39 | 19 | NBR | N230SV | #7360SB | 48 | 1.2 | TBzTD | 4.5 | 2 | 12 | Resin particle-containing masterbatch No. 6 |
| 40 | 20 | | | | | | | | 2 | 12 | Resin particle-containing masterbatch No. 11 |
| 41 | 21 | | | | | | | | 1 | 12 | Resin particle-containing masterbatch No. 8 |
| 42 | 22 | | | | | | | | 8 | 12 | Resin particle-containing masterbatch No. 9 |
| 43 | 23 | | | | | | | | 9 | 12 | Resin particle-containing masterbatch No. 10 |

Example 1

[Electrophotographic Roller T1]

[1. Electro-Conductive Substrate]

A substrate obtained by applying a thermosetting resin containing 10% by mass of carbon black to a substrate made of stainless steel and having a diameter of 6 mm and a length of 252.5 mm and drying the resin was used as an electro-conductive substrate.

[2. Formation of Electro-Conductive Elastic Layer]

The circumferential surface of the electro-conductive substrate having the electro-conductive substrate as a central shaft was cylindrically covered with the electro-conductive resin composition No. 2 produced in Production Example 22 using an extrusion molding apparatus including a crosshead. The thickness of the covering electro-conductive resin composition No. 2 was adjusted to 1.75 mm.

Foaming treatment for vulcanizing the roller after extrusion in a hot blast stove at 160° C. for 1 hour was performed, followed by the removal of the ends of the electro-conductive resin layer, resulting in shortening of the length to 224.2 mm to produce a roller having a preliminary covering layer. The outer circumferential surface of the obtained roller was polished using a plunge cutting mode cylinder polisher. A vitrified grindstone was used as a polish grindstone, abrasive grains were green silicon carbide (GC), and the particle size was 100 mesh. The number of revolutions of the roller was 350 rpm, and the number of revolutions of the polish grindstone was 2050 rpm. Polish was performed with the cutting speed set as 20 mm/min and the spark out time (time at cutting of 0 mm) set as 0 seconds to produce an electro-conductive roller having an electro-conductive elastic layer (covering layer). The thickness of the electro-conductive elastic layer was adjusted to 1.5 mm. The crown amount of this roller (the average value of the differences between the outer diameter of a central portion and the outer diameters of the positions 90 mm away from the central portion in the direction of the both ends) was 120 μm.

An electrophotographic Roller T1 was obtained by performing post heat treatment at 210° C. for 1 hour in a hot blast stove after polish. This electrophotographic roller T1 had an electro-conductive elastic layer having convex portions derived from the edges of the openings of a bowl-shaped resin particle, and concave portions derived from the openings of a bowl-shaped resin particle on the surface thereof.

The following physical properties measurement and image evaluation were performed on the thus obtained electrophotographic roller T1.

[3. Method for Measuring Physical Properties of Electrophotographic Roller]

[3-1. Measurement of Surface Roughness Rzjis and Average Unevenness Interval Sm of Electrophotographic Roller]

Measurement was performed according to Japanese Industrial Standard (JIS) B 0601-1994, the standard of surface roughness, using a surface roughness measuring instrument (trade name: SE-3500, manufactured by Kosaka Laboratory Ltd.). Six points of the electrophotographic roller T1 that were selected at random were measured, and Rz and Sm were defined as the average values thereof. The cutoff value was 0.8 mm, and the evaluated length is 8 mm.

[3-2. Shape Measurement of Bowl-Shaped Resin Particle]

Five points in the longitudinal direction that were the central portion in the longitudinal direction of the electrophotographic roller T1, the positions 45 mm away from the central portion in the directions of both ends, and the positions 90 mm away from the central portion in the directions of both ends were on each of the two lines (phase 0 and 180) in the circumferential direction of the electrophotographic roller T1. Measurement points were the ten points in total. In each of these measurement points, 500 μm of the electro-conductive elastic layer was cut out in 20 nm using a focused ion beam machining observation apparatus (trade name: FB-2000C, manufactured by Hitachi, Ltd.), and the section image was taken. The stereoscopic image of the bowl-shaped resin particle was calculated by combining the obtained section images. The "maximum size" 55 as illustrated in FIG. 4C and the "minimum diameter of an opening" 63 illustrated in FIG. 5A to FIG. 5E were calculated from the stereoscopic image. The definition of the "maximum size" is as described above.

In any five points of a bowl-shaped resin particle, "differences between outer diameters and inner diameters", that is, "thicknesses of a shell", of the bowl-shaped resin particle was calculated from the above-mentioned stereoscopic image. The average value of 100 measured values in total obtained by performing such measurement on 10 resin particles in the visual field was calculated. "The maximum size", "the minimum diameter of the opening" and "the thickness of the shell" that are shown in Table 7 are the average values calculated by the above-mentioned method. At the time of the measurement of the thicknesses of shells, as to each bowl-shaped resin particle, it was confirmed that the thickness of the thickest portion of the shell was less than twice the thickness of the thinnest portion, namely that the thickness of the shell was almost even.

[3-3. Difference in Height Between Vertex of Convex Portion and Bottom of Concave Portion of Surface of Electrophotographic Roller]

The surface of the electrophotographic roller T1 was observed in the visual field having a length of 0.5 mm and a width of 0.5 mm using a laser microscope (trade name: LSM5 PASCAL, manufactured by Carl Zeiss AG). A two-dimensional image data was obtained by scanning the X-Y plane in the visual field with a laser beam. Additionally, a three-dimensional image data was obtained by moving the focus in the Z direction and repeating the above-mentioned scan. Consequently, it was first confirmed that a concave portion derived from the opening of a bowl-shaped resin particle and a convex portion derived from the edge of the opening of the bowl-shaped resin particle existed. Additionally, a difference in height 54 (refer to FIG. 4C) between the vertex of the above-mentioned convex portion and the bottom of the above-mentioned concave portion was calculated. Such an operation was performed on two bowl-shaped resin particles in the visual field. The average value of 100 resin particles in total obtained by performing the same measurement on 50 points in the longitudinal direction of the electrophotographic roller T1 was calculated, and this value was shown in Table 7 as "the difference in height".

[3-4. Measurement of Electrical Resistance Value of Electrophotographic Roller]

Figure 10:
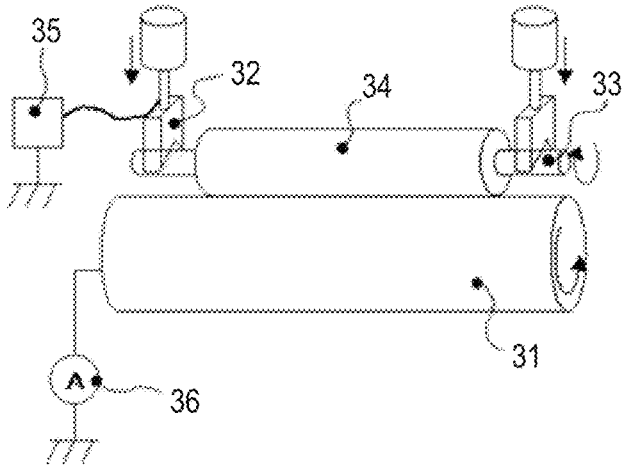
FIG. 10 is a schematic view of an electrical resistance measurement apparatus for use in the present disclosure.

FIG. 10 is a measuring apparatus of the electrical resistance value of the electrophotographic roller. The measuring apparatus was equipped with the electrophotographic roller T1 as an electrophotographic roller 34, load was applied to both ends of the electro-conductive substrate 33 by bearings 32, and the electrophotographic roller 34 was brought in contact with a cylindrical metal 31 having the same curvature as the electrophotographic photosensitive member so as to be parallel to the cylindrical metal 31. In these conditions, the cylindrical metal 31 was rotated by a motor (not illustrated), and a direct current voltage of −200V was applied from a stabilized power supply 35 with the electrophotographic roller T1 in contact with the cylindrical metal 31 driven into rotation. A current that flowed at this time was measured by an ampere meter 36, and the electrical resistance value of the electrophotographic roller T1 was calculated. Load was 4.9 Ns each, the cylindrical metal 31 was 30 mm in diameter, and the rotation of the cylindrical metal 31 was at a circumferential speed of 45 mm/sec. The electrophotographic roller T1 was left to stand under the conditions of a temperature of 23° C. and relative humidity of 50% for 24 hours or more before measurement, and measurement was performed using the measuring apparatus placed under the same conditions.

[3-5. Measurement of Area Distribution and Positional Distribution of Contact Portions at Time of Pressing Electrophotographic Roller Against Glass Plate]

Figure 11:
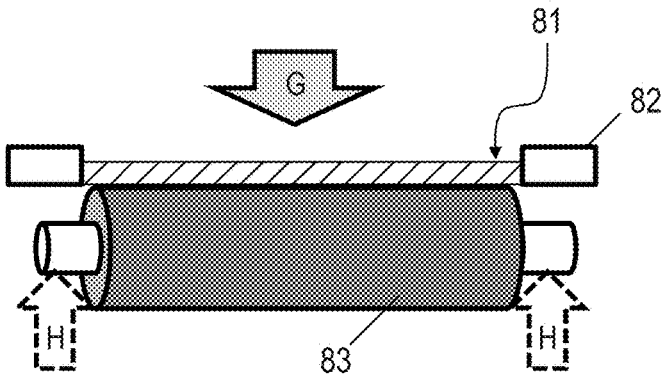
FIG. 11 is a schematic view of a tool for abutment of a glass plate with the surface of an electrophotographic roller.

A glass plate (width (W2): 300 mm×length (L): 50 mm, thickness: 2 mm, quality of material: BK7, profile irregularity: double side optical polish, and parallelism: 1 minute or less) was used as a glass plate brought in contact with the electro-conductive roller T1. Using a jig 82 illustrated in FIG. 11, the glass plate is place so that the width (W2) of a first surface as a contact surface of the glass plate 81 covered over the entire width in the longitudinal direction of an electrophotographic roller T1 as an electrophotographic roller 83 and the first surface of the glass plate 81 was parallel to the rotating shaft of the electro-conductive roller T1. The electrophotographic roller T1 was pressed against the first surface of the glass plate 81 by applying a load H by springs from the electro-conductive substrate portions on both ends of the electrophotographic roller T1 with these configuration conditions maintained. The contact surface between the electrophotographic roller T1 and the first surface of the glass plate 81 was observed through the glass plate from a second surface side on the opposite side to the first surface of the glass plate 81 (from an arrow G direction side) by a video microscope (trade name: DIGITAL MICROSCOPE VHX-500, manufactured by KEYENCE CORPORATION) with the conditions maintained. Observation was performed at a magnification of 200 times.

The load H was set so that a contact pressure M calculated from the following Expression (3) was 6.5 g/mm$^2$.

$$M=2H/N \quad \text{(Expression 3)}$$

N is the area of a nip formed when the glass plate 81 is pressed against the electrophotographic roller T1 by the load H.

The nip area N, the number of the contact portions that existed in a square region where the length of the nip in the circumferential direction is defined as a side, the density of the contact portions, the S in the Expression (1), and the D in the Expression (2) showing position distribution were calculated hereinafter.

Only the contact portions formed between the electrophotographic roller T1 and the glass plate in the observed image were extracted using image analysis software (ImagePro-Plus (R), manufactured by Media Cybernetics, Inc.), and binarization was performed. Then, opening processing was performed on the binarized image once, and closing processing thereafter was performed once for noise removal. The opening processing is image-processing operations for performing shrinkage and expansion and performing shrinkage as many times as expansion, and enables excluding very small extraction regions considered to be noise. The closing processing is image-processing operations for performing expansion and shrinkage and performing expansion as many times as shrinkage, and enables connecting extraction regions divided at the time of extraction although the extraction regions should have been connected originally as contact portions. The opening processing and the closing processing enable extracting contact portions appropriately.

A method for calculating a nip area N will first be described. The region sandwiched between the two straight lines that passed through the two points of both ends in the circumferential direction of the contact points between the electrophotographic roller T1 and the glass plate in the observation region and were parallel to the longitudinal direction of the electrophotographic roller T1 was defined as a nip region, which was cut out using the above-mentioned software. The lengths in the circumferential direction of this cut nip region were measured at five points in the longitudinal direction, which were the central portion in the longitudinal direction of the electrophotographic roller T1, the positions 45 mm and 90 mm away from the central portion in the directions of both ends, and a nip area N was calculated by multiplying the average value thereof by the length in the longitudinal direction of the nip in contact between the electrophotographic roller T1 and the glass plate.

Then, a square that had a length in the circumferential direction of the nip as one side in the nip region was cut out by the above-mentioned software. Cutting out was performed at any position in the longitudinal direction of the nip in an observation image, and the cut region was defined as an image analysis region. The number of contact portions that existed in the image analysis region was counted, and the number of the contact portions existed in a square region where a length in the circumferential direction of the nip is defined as the length of one side was calculated. Three points, which were the longitudinal central portion and the crown positions (positions 90 mm away from the longitudinal central portion in the directions of both ends) of the electrophotographic roller T1, were on each of three lines at intervals of 120° in the circumferential direction. The above-mentioned operation was performed at the nine points in total. The average value at those nine points was defined as the number of contact portions that existed in a square region where a length in the circumferential direction of the nip is defined as the length of one side. The density of the contact portions was calculated from the area of the above-mentioned square and the number of the contact portions that existed in the square.

Next, a method for calculating S will be described. The areas of contact portions were each calculated by the above-mentioned software, and the average value Save' and the standard deviation Sσ' were calculated. Then, the variation coefficient S', which was a value obtained by dividing the Sσ' by the Save', was calculated. Three points, which were the longitudinal central portion and the crown positions (positions 90 mm away from the longitudinal central portion in the directions of both ends) of the electrophotographic roller T1, were on each of three lines at intervals of 120° in the circumferential direction. The above-mentioned operation was performed at the nine points in total. The average value of Save's at those nine points was defined as Save(6.5) at a contact pressure M of 6.5 g/mm$^2$, and the average value of the coefficients of variation S's was defined as S(6.5).

Next, a method for calculating D will be described. As to all the contact portions that existed in an image analysis region, the centers of gravity of the contact portions were considered as generatrices, followed by Voronoi tessellation. Specifically, pruning processing was performed in the image analysis region using the above-mentioned software. The areas of Voronoi polygons obtained by Voronoi tessellation were each calculated, and the average value Dave' and the standard deviation Dσ' thereof were calculated. Then, the variation coefficient D', which was a value obtained by dividing the Dσ' by the Dave', was calculated. Three points, which were the longitudinal central portion and the crown positions (positions 90 mm away from the longitudinal central portion in the directions of both ends) of the electrophotographic roller, were on each of three lines at intervals of 120° in the circumferential direction. The above-mentioned operation was performed at the nine points in total. The average value of Dave's at those nine points was defined as Dave(6.5) at a contact pressure M of 6.5 g/mm$^2$, and the average value of the coefficients of variation D's was defined as D(6.5).

Then, the number of contact portions that existed in a square region where the length of the nip in a circumferential direction is defined as the length of one side, the density of contact portions, Save(10.9), S(10.9), Dave(10.9), and D(10.9) at the contact pressure M of 10.9 g/mm$^2$ were calculated by changing the loads of both ends so that the contact pressure M was 10.9 g/mm$^2$ and performing the same operation.

Additionally, the number of contact portions that existed in a square region that where the length of the nip in a circumferential direction is defined as the length of one side, the density of contact portions, Save(14.3), S(14.3), Dave (14.3), and D(14.3) at the contact pressure M of 14.3 g/mm$^2$ were calculated by changing the loads of both ends so that the contact pressure M was 14.3 g/mm$^2$ and performing the same operation.

The average values of the Ss and the Ds at contact pressures M of 6.5 g/mm$^2$, 10.9 g/mm$^2$ and 14.3 g/mm$^2$ were defined as S and D used for the present disclosure.

[3-6. Spot-Like Image Evaluation as Charging Roller]

A monochromic laser printer manufactured by Canon Inc. ("LBP6700" (trade name)), which was an electrophotographic apparatus having a configuration illustrated in FIG. 8 was converted into a printer having a process speed of 370 mm/sec, and voltage was further applied on the electrophotographic roller T1 externally. The peak-to-peak voltage (Vpp), the frequency (f) and the direct current voltage (Vdc) of the applied voltage were 1800 V, 1350 Hz and −600 V as an alternating current voltage, respectively. The resolution of the image was output at 600 dpi.

A toner cartridge 524II for the above-mentioned printers was used as a process cartridge. An attached charging roller was removed from the above-mentioned process cartridge, and the manufactured electrophotographic roller T1 was set as a charging roller. The electrophotographic roller T1 was brought in contact with an electrophotographic photosensitive member under a pressing pressure of 4.9 N applied to an end, 9.8 N in total applied to both ends, by springs. Durability evaluation was performed after this process cartridge was acclimatized to low-temperature and low-humidity conditions of a temperature of 15° C. and RH of 10% for 24 hours.

Specifically, a two-sheet intermittent durability test (the rotation of the printer is stopped for 3 seconds every two sheets, followed by durability) of printing a horizontal line image having widths of 2 dots and intervals of 176 dots of in the direction perpendicular to the rotation direction of the electrophotographic photosensitive member was performed. A halftone image (an image in which horizontal lines having widths of 1 dot and intervals of 2 dots were drawn in the rotation direction of the electrophotographic photosensitive member and in the direction perpendicular to the electrophotographic photosensitive member) was output every 10000 sheets. The above-mentioned durability test was performed by printing up to 60000 sheets, followed by evaluation. As evaluation, it was rated whether spot-like defects due to stains and unevenness resulting from uneven rotation existed or not in the electrophotographic image by the following standard by observing the halftone image visually.

Rank 1: Spot-like defects are not found.

Rank 2: A few spot-like defects are found slightly.

Rank 3: Spot-like defects are found in some regions.

Rank 4: Spot-like defects are found in some regions and are marked.

Rank 5: Spot-like defects are found over a wide area and are marked.

[3-7. Quantification of Amount of External Additive Attached to Surface]

The electrophotographic roller that was presented for the test according to the above 3-6 was presented was taken out of the process cartridge, and the amount of an external additive attached to the surface of the charging roller was quantitated using a scanning electron microscope (S-3700N, manufactured by Hitachi High-Technologies Corporation). Specifically, quantification was performed on the range of 500 μm×600 μm at any position of the charging roller using an energy dispersive type X-rays spectroscopic analyzer (trade name: Quantax, manufactured by Bruker Japan K. K.) that accompanies the above-mentioned scanning electron microscope. An all-round type 30 $mm^2$ EDS detector (trade name: XFlash 6|10, manufactured by Bruker Japan K. K.) was used as a detector.

As observation conditions, the accelerating voltage was 20 kV, and the amount [% by atom] of Si detected was defined as the amount of an external additive attached. Three points, which were the longitudinal central portion and the crown positions (positions 90 mm away from the longitudinal central portion in the directions of both ends) of the electrophotographic roller T1, were on each of three lines at intervals of 120° in the circumferential direction. This measurement was performed at the nine points in total. When the average value thereof was defined as the amount of the external additive attached by the durability test, the amount was 0.90% by atom.

(Examples 2 to 23, Comparative Examples 1 to 8)

[Electrophotographic Roller T2]

An electrophotographic Roller T2 was manufactured in the same manner as for the electrophotographic roller T1, except that a heating method at 160° C. after extrusion was changed from a hot blast stove to an induction-heating apparatus.

[Electrophotographic Roller T3]

An electrophotographic roller T3 was manufactured in the same manner as for the electrophotographic roller T2, except that an electro-conductive surface layer was formed by the following technique without providing post-heat treatment at 210° C. to an electro-conductive elastic layer after polish.

A method for forming an electro-conductive surface layer will be described. Methyl isobutyl ketone was added to caprolactone-modified acrylic polyol solution "PLACCEL DC2016" (trade name, produced by Daicel Corporation), and the solid content was adjusted to 10% by mass. Other three components illustrated in the columns of components (1) in the following Table 6 were added to 1000 parts by mass of this solution (solid content of acrylic polyol was 100 parts by mass) to prepare a mixed solution. Subsequently, a glass bottle having a capacity of 450 mL was charged with 200 parts by mass of the above-mentioned mixed solution along with 200 parts by mass of glass beads having an average particle size of 0.8 mm as a medium, and dispersion was performed for 24 hours using a paint shaker dispersion machine. Then, a crosslinking acrylics particle (trade name: MZ-30HN, produced by Soken Chemical & Engineering Co., Ltd.) illustrated in the column of a component (2) in Table 6 were added, followed by dispersion for 5 minutes again, the glass bead was removed to produce an electro-conductive resin coating liquid.

An electro-conductive roller having a polished electro-conductive elastic layer was immersed into the above-mentioned electro-conductive resin coating liquid with the longitudinal direction thereof in the perpendicular direction, and coated by dipping. As coating conditions, the immersion time was 9 seconds, and the speed at which the roller was raised from the electro-conductive resin coating liquid was the initial speed of 20 mm/sec and the last speed of 2 mm/sec, and the speed was changed linearly with time in the meantime. The obtained coated article was air-dried at room temperature for 30 minutes, dried in a hot wind circulation dryer at a temperature of 80° C. for 1 hour and further dried at a temperature of 160° C. for 1 hour. Thus, an electro-conductive surface layer was formed on the outer circumferential surface of the electro-conductive elastic layer.

TABLE 6

| | Material | Amount of material used (part by mass) |
|---|---|---|
| Component (1) | Caprolactone-modified acrylic polyol solution (trade name: PLACCEL DC2016, produced by Daicel Corporation) | 100 |
| | Carbon Black (trade name: MA-100, produced by Mitsubishi Chemical Corporation) | 45 |
| | Modified dimethyl silicone oil (trade name: SH28PA, produced by Dow Corning Toray Silicone Co., Ltd.) | 0.08 |
| | Blocked isocyanate mixture (mixture of butanone oxime block bodies of hexamethylene diisocyanate (HDI) and isophorone diisocyanate (IPDI) at ratio of 5:5) | 25 |
| Component (2) | Crosslinking acrylic particle (trade name: MZ-30HN, produced by Soken Chemical & Engineering Co., Ltd.) | 20 |

[Electrophotographic Roller T4]

An electrophotographic roller T4 was manufactured in the same manner as for the electrophotographic roller T2, except that the electro-conductive resin composition No. 2 was changed into the electro-conductive resin composition No. 3 and the curing technique was changed so that electron beam irradiation treatment illustrated below was performed on the electro-conductive elastic layer after polish instead of post-heat treatment at 210° C.

Electron beam irradiation was performed by an area type electron beam irradiation source (trade name: EC150/45/40 mA, manufactured by IWASAKI ELECTRIC CO., LTD.). An electron beam irradiation apparatus having this area type electron beam irradiation source has a structure as illustrated in FIG. 6 and FIG. 7. The schematic sectional view in a plane perpendicular to the conveyance direction of the roller in FIG. 6. (a plane perpendicular to the surface of the sheet) is FIG. 7. An electron beam was irradiated by conveying the roller in the direction of the arrow in FIG. 6 at a process speed of 10 mm/s with the oxygen concentration in an atmosphere adjusted to 500 ppm or less by nitrogen purge and the roller rotated at 300 rpm around the electro-conductive substrate of the roller as a rotation axis. As to electron irradiation conditions, the electronic current was adjusted so that the accelerating voltage was 80 kV and the dose was 1000 kGy.

[Electrophotographic Roller T5]

An electrophotographic roller T5 was manufactured in the same manner as for the electrophotographic roller T4, except that the electro-conductive resin composition No. 3 was changed into the electro-conductive resin composition No. 4.

[Electrophotographic Rollers T6 to T21]

Electrophotographic rollers T6 to T21 were manufactured in the same manner as for the electrophotographic roller T1, except that any of the electro-conductive resin composition, the heating method after extrusion or the curing technique after polish was changed as in Table 7.

When the quantification of the amount of the external additive attached of the surface of the durable roller was performed as to an electrophotographic roller T24 of Comparative Example 1, the amount of Si was 0.98% by atom.

[Electrophotographic Roller T22]

An electrophotographic roller T22 was manufactured in the same manner as for the electrophotographic roller T1, except that the heating time of post-heat treatment after polish at 210° C. was changed from 1 hour to 1 hour and 30 minutes.

[Electrophotographic Roller T23]

An electrophotographic roller T23 was manufactured in the same manner as for the electrophotographic roller T2, except that the heating time of post-heat treatment after polish at 210° C. was changed from 1 hour to 1 hour and 30 minutes.

[Electrophotographic Rollers T24 to T31]

Electrophotographic rollers T24 to T31 were manufactured in the same manner as for the electrophotographic roller T1, except that any of the electro-conductive resin composition, the heating method after extrusion or the hardening technique after polish was changed as in Table 7.

The physical property values and evaluation results of the electrophotographic rollers are shown in Tables 7 and 8-1 to 8-3.

TABLE 7

| | | Electro-photo-graphic roller No. | Electro-conductive resin composition | Foaming method | Curing technique | Electrical resistance of roller [Ω] | Rz [μm] | Sm [μm] | Difference in altitude [μm] | Maximum diameter [μm] | Minimum diameter of opening [μm] | Thick-ness of shell [μm] |
|---|---|---|---|---|---|---|---|---|---|---|---|---|
| Example | 1 | T1 | 2 | Hot blast bath | Heat curing | $2.8 \times 10^5$ | 24 | 110 | 30 | 39 | 24 | 0.6 |
| | 2 | T2 | 2 | Induction heating | Heat curing | $2.1 \times 10^5$ | 26 | 97 | 32 | 36 | 26 | 0.5 |
| | 3 | T3 | 2 | Induction heating | Surface coating | $8.6 \times 10^5$ | 23 | 105 | 29 | 34 | 23 | 0.5 |
| | 4 | T4 | 3 | Induction heating | Electron beam | $4.6 \times 10^5$ | 22 | 115 | 30 | 34 | 24 | 0.5 |
| | 5 | T5 | 4 | Induction heating | Electron beam | $3.4 \times 10^5$ | 20 | 124 | 28 | 33 | 23 | 0.6 |
| | 6 | T6 | 5 | Induction heating | Electron beam | $2.6 \times 10^5$ | 18 | 128 | 27 | 32 | 21 | 0.6 |
| | 7 | T7 | 6 | Induction heating | Electron beam | $2.1 \times 10^5$ | 17 | 132 | 26 | 30 | 20 | 0.6 |
| | 8 | T8 | 7 | Induction heating | Heat curing | $4.6 \times 10^5$ | 30 | 85 | 37 | 42 | 30 | 0.4 |
| | 9 | T9 | 8 | Hot blast bath | Heat curing | $1.6 \times 10^5$ | 26 | 105 | 31 | 39 | 25 | 0.5 |
| | 10 | T10 | 9 | Hot blast bath | Heat curing | $2.3 \times 10^5$ | 25 | 101 | 31 | 41 | 27 | 0.5 |
| | 11 | T11 | 9 | Induction heating | Heat curing | $1.9 \times 10^5$ | 27 | 94 | 33 | 37 | 27 | 0.5 |
| | 12 | T12 | 10 | Hot blast bath | Heat curing | $1.3 \times 10^5$ | 29 | 99 | 35 | 40 | 28 | 0.5 |
| | 13 | T13 | 12 | Hot blast bath | Heat curing | $4.3 \times 10^5$ | 12 | 75 | 15 | 21 | 9 | 0.5 |
| | 14 | T14 | 13 | Hot blast bath | Heat curing | $5.4 \times 10^5$ | 10 | 80 | 15 | 19 | 9 | 0.5 |
| | 15 | T15 | 13 | Induction heating | Heat curing | $4.9 \times 10^5$ | 11 | 72 | 16 | 18 | 10 | 0.6 |
| | 16 | T16 | 15 | Hot blast bath | Heat curing | $9.0 \times 10^4$ | 45 | 130 | 54 | 68 | 40 | 1 |
| | 17 | T17 | 16 | Hot blast bath | Heat curing | $9.9 \times 10^4$ | 44 | 136 | 52 | 66 | 39 | 1.1 |
| | 18 | T18 | 16 | Induction heating | Heat curing | $8.6 \times 10^4$ | 47 | 122 | 58 | 64 | 42 | 0.9 |
| | 19 | T19 | 17 | Induction heating | Heat curing | $3.4 \times 10^4$ | 22 | 115 | 26 | 30 | 20 | 0.8 |
| | 20 | T20 | 18 | Induction heating | Heat curing | $5.6 \times 10^5$ | 30 | 91 | 36 | 40 | 28 | 0.4 |
| | 21 | T21 | 23 | Induction heating | Heat curing | $4.4 \times 10^4$ | 75 | 154 | 88 | 102 | 70 | 1.4 |
| | 22 | T22 | 2 | Hot blast bath | Heat curing | $4.4 \times 10^5$ | 24 | 110 | 30 | 39 | 24 | 0.6 |
| | 23 | T23 | 2 | Induction heating | Heat curing | $3.9 \times 10^5$ | 26 | 97 | 32 | 36 | 26 | 0.5 |
| Comparative Example | 1 | T24 | 1 | Hot blast bath | Electron beam | $2.8 \times 10^5$ | 24 | 110 | 30 | 39 | 24 | 0.6 |
| | 2 | T25 | 11 | Hot blast bath | Electron beam | $5.2 \times 10^5$ | 11 | 79 | 14 | 22 | 10 | 0.6 |
| | 3 | T26 | 14 | Hot blast bath | Electron beam | $9.7 \times 10^4$ | 43 | 135 | 53 | 72 | 40 | 1.2 |
| | 4 | T27 | 19 | Hot blast bath | Electron beam | $1.4 \times 10^5$ | 23 | 102 | 29 | 43 | 22 | 0.6 |
| | 5 | T28 | 20 | Hot blast bath | Electron beam | $2.0 \times 10^5$ | 23 | 106 | 29 | 43 | 22 | 0.6 |
| | 6 | T29 | 21 | Induction heating | Electron beam | $2.4 \times 10^5$ | 23 | 115 | 29 | 38 | 24 | 0.6 |
| | 7 | T30 | 22 | Hot blast bath | Electron beam | $5.7 \times 10^4$ | 70 | 160 | 80 | 110 | 68 | 1.5 |
| | 8 | T31 | 1 | Hot blast bath | Heat curing | $2.7 \times 10^5$ | 24 | 110 | 30 | 39 | 24 | 0.6 |

TABLE 8-1

| | | Electrophotographic roller No. | Circumferential length of nip [μm] | | | The number of the contact portions existing in a square region having the length of a nip in the circumferential direction as a side | | |
|---|---|---|---|---|---|---|---|---|
| | | | Contact pressure M 6.5 g/mm2 | Contact pressure M 10.9 g/mm2 | Contact pressure M 14.3 g/mm2 | Contact pressure M 6.5 g/mm2 | Contact pressure M 10.9 g/mm2 | Contact pressure M 14.3 g/mm2 |
| Example | 1 | T1 | 400 | 480 | 560 | 23 | 35 | 50 |
| | 2 | T2 | 400 | 480 | 560 | 26 | 39 | 56 |
| | 3 | T3 | 415 | 500 | 580 | 25 | 40 | 58 |
| | 4 | T4 | 430 | 520 | 590 | 12 | 20 | 30 |
| | 5 | T5 | 470 | 520 | 600 | 9 | 15 | 22 |
| | 6 | T6 | 465 | 540 | 610 | 8 | 11 | 16 |

TABLE 8-1-continued

| | | Electrophotographic roller No. | Circumferential length of nip [μm] | | | The number of the contact portions existing in a square region having the length of a nip in the circumferential direction as a side | | |
|---|---|---|---|---|---|---|---|---|
| | | | Contact pressure M 6.5 g/mm2 | Contact pressure M 10.9 g/mm2 | Contact pressure M 14.3 g/mm2 | Contact pressure M 6.5 g/mm2 | Contact pressure M 10.9 g/mm2 | Contact pressure M 14.3 g/mm2 |
| | 7 | T7 | 500 | 570 | 650 | 8 | 11 | 15 |
| | 8 | T8 | 400 | 480 | 560 | 27 | 41 | 60 |
| | 9 | T9 | 390 | 475 | 550 | 24 | 37 | 52 |
| | 10 | T10 | 390 | 475 | 550 | 24 | 37 | 53 |
| | 11 | T11 | 400 | 480 | 560 | 26 | 39 | 56 |
| | 12 | T12 | 395 | 475 | 555 | 26 | 39 | 56 |
| | 13 | T13 | 380 | 460 | 540 | 23 | 35 | 51 |
| | 14 | T14 | 380 | 460 | 540 | 22 | 34 | 49 |
| | 15 | T15 | 385 | 465 | 545 | 25 | 38 | 56 |
| | 16 | T16 | 430 | 520 | 590 | 23 | 35 | 48 |
| | 17 | T17 | 430 | 520 | 590 | 24 | 38 | 52 |
| | 18 | T18 | 435 | 525 | 595 | 25 | 40 | 55 |
| | 19 | T19 | 440 | 530 | 600 | 25 | 38 | 52 |
| | 20 | T20 | 450 | 540 | 610 | 25 | 38 | 51 |
| | 21 | T21 | 475 | 560 | 630 | 24 | 36 | 49 |
| | 22 | T22 | 385 | 465 | 545 | 22 | 32 | 46 |
| | 23 | T23 | 385 | 465 | 545 | 24 | 36 | 50 |
| Comparative Example | 1 | T24 | 430 | 520 | 590 | 22 | 37 | 52 |
| | 2 | T25 | 400 | 480 | 580 | 21 | 35 | 58 |
| | 3 | T26 | 475 | 570 | 615 | 23 | 39 | 51 |
| | 4 | T27 | 410 | 490 | 570 | 22 | 36 | 54 |
| | 5 | T28 | 410 | 490 | 570 | 18 | 31 | 46 |
| | 6 | T29 | 450 | 545 | 615 | 25 | 42 | 59 |
| | 7 | T30 | 500 | 580 | 700 | 22 | 33 | 54 |
| | 8 | T31 | 430 | 520 | 590 | 22 | 36 | 52 |

TABLE 8-2

| | | Electrophotographic roller No. | Contact portion density [portions/mm$^2$] | | | $S_{ave}$ [μm$^2$] | | |
|---|---|---|---|---|---|---|---|---|
| | | | Contact pressure M 6.5 g/mm2 | Contact pressure M 10.9 g/mm2 | Contact pressure M 14.3 g/mm2 | Contact pressure M 6.5 g/mm2 | Contact pressure M 10.9 g/mm2 | Contact pressure M 14.3 g/mm2 |
| Example | 1 | T1 | 142 | 150 | 159 | 23.1 | 25.4 | 27.4 |
| | 2 | T2 | 161 | 170 | 179 | 26.3 | 28.1 | 31.7 |
| | 3 | T3 | 144 | 160 | 172 | 40.3 | 45.6 | 53.1 |
| | 4 | T4 | 64 | 75 | 86 | 46.5 | 50.9 | 63.2 |
| | 5 | T5 | 40 | 54 | 60 | 46.8 | 50.1 | 64.3 |
| | 6 | T6 | 35 | 39 | 43 | 50.6 | 55.8 | 71.9 |
| | 7 | T7 | 30 | 33 | 36 | 56.1 | 64.4 | 81.6 |
| | 8 | T8 | 171 | 179 | 190 | 25.3 | 28.8 | 32.4 |
| | 9 | T9 | 155 | 162 | 172 | 18.5 | 20.8 | 23.4 |
| | 10 | T10 | 156 | 165 | 174 | 18.4 | 20.1 | 23.1 |
| | 11 | T11 | 161 | 170 | 180 | 21.4 | 24.6 | 28.3 |
| | 12 | T12 | 164 | 172 | 182 | 20.2 | 22.4 | 25.8 |
| | 13 | T13 | 158 | 165 | 174 | 10.3 | 12.5 | 14.8 |
| | 14 | T14 | 152 | 160 | 169 | 10.0 | 12.2 | 14.4 |
| | 15 | T15 | 170 | 178 | 187 | 12.6 | 14.0 | 15.1 |
| | 16 | T16 | 123 | 130 | 139 | 44.4 | 49.4 | 57.9 |
| | 17 | T17 | 131 | 140 | 150 | 44.4 | 49.1 | 57.6 |
| | 18 | T18 | 131 | 145 | 155 | 46.1 | 52.0 | 61.4 |
| | 19 | T19 | 127 | 135 | 144 | 51.3 | 58.7 | 67.8 |
| | 20 | T20 | 123 | 129 | 136 | 64.8 | 70.8 | 80.1 |
| | 21 | T21 | 106 | 115 | 123 | 83.8 | 95.0 | 111.0 |
| | 22 | T22 | 148 | 150 | 154 | 14.7 | 15.5 | 15.5 |
| | 23 | T23 | 161 | 165 | 170 | 15.5 | 16.3 | 16.6 |
| Comparative Example | 1 | T24 | 121 | 137 | 150 | 47.5 | 55.3 | 71.9 |
| | 2 | T25 | 133 | 152 | 171 | 27.6 | 35.3 | 48.6 |
| | 3 | T26 | 102 | 120 | 134 | 79.3 | 98.5 | 133.0 |
| | 4 | T27 | 128 | 148 | 165 | 35.1 | 46.8 | 62.1 |
| | 5 | T28 | 110 | 128 | 141 | 35.0 | 46.0 | 62.2 |
| | 6 | T29 | 121 | 140 | 157 | 65.9 | 77.4 | 99.5 |
| | 7 | T30 | 86 | 99 | 111 | 105.3 | 130.3 | 168.7 |
| | 8 | T31 | 118 | 132 | 149 | 42.6 | 50.4 | 65.3 |

region having a side whose length is equal to a length

TABLE 8-3

| | | Electrophotographic roller No. | S | $D_{ave}$ [μm²] Contact pressure M 6.5 g/mm2 | Contact pressure M 10.9 g/mm2 | Contact pressure M 14.3 g/mm2 | D | Spot image |
|---|---|---|---|---|---|---|---|---|
| Example | 1 | T1 | 0.92 | 2800 | 2500 | 2350 | 1.10 | 2 |
| | 2 | T2 | 0.87 | 2200 | 2000 | 1900 | 1.05 | 2 |
| | 3 | T3 | 0.87 | 2200 | 2000 | 1900 | 1.05 | 2 |
| | 4 | T4 | 0.87 | 6200 | 5400 | 5100 | 1.08 | 3 |
| | 5 | T5 | 0.89 | 8600 | 7500 | 7000 | 1.08 | 3 |
| | 6 | T6 | 0.88 | 10500 | 9300 | 8700 | 1.09 | 4 |
| | 7 | T7 | 0.90 | 12000 | 10600 | 9900 | 1.10 | 4 |
| | 8 | T8 | 0.84 | 1550 | 1400 | 1300 | 1.02 | 2 |
| | 9 | T9 | 0.74 | 2500 | 2200 | 2000 | 1.09 | 1 |
| | 10 | T10 | 0.70 | 2500 | 2200 | 2000 | 0.90 | 1 |
| | 11 | T11 | 0.68 | 2150 | 1900 | 1800 | 0.85 | 1 |
| | 12 | T12 | 0.75 | 1950 | 1800 | 1700 | 1.18 | 2 |
| | 13 | T13 | 0.88 | 2100 | 1900 | 1800 | 1.06 | 1 |
| | 14 | T14 | 0.84 | 2100 | 1900 | 1800 | 0.98 | 1 |
| | 15 | T15 | 0.84 | 1900 | 1700 | 1600 | 0.94 | 1 |
| | 16 | T16 | 1.00 | 3700 | 3300 | 3050 | 1.20 | 3 |
| | 17 | T17 | 0.95 | 3400 | 3100 | 2900 | 1.08 | 2 |
| | 18 | T18 | 0.93 | 3300 | 3000 | 2800 | 1.02 | 2 |
| | 19 | T19 | 0.94 | 3600 | 3200 | 3000 | 1.04 | 2 |
| | 20 | T20 | 0.96 | 3900 | 3500 | 3300 | 1.12 | 3 |
| | 21 | T21 | 0.94 | 4400 | 4000 | 3800 | 1.06 | 3 |
| | 22 | T22 | 0.94 | 2600 | 2500 | 2450 | 1.12 | 2 |
| | 23 | T23 | 0.86 | 2100 | 2000 | 1950 | 1.03 | 1 |
| Comparative Example | 1 | T24 | 1.10 | 3400 | 3000 | 2700 | 1.24 | 5 |
| | 2 | T25 | 1.02 | 2500 | 2200 | 1950 | 1.21 | 5 |
| | 3 | T26 | 1.15 | 4000 | 3600 | 3350 | 1.26 | 5 |
| | 4 | T27 | 0.79 | 3300 | 2900 | 2700 | 1.25 | 5 |
| | 5 | T28 | 0.94 | 3750 | 3300 | 3000 | 1.31 | 5 |
| | 6 | T29 | 1.02 | 3100 | 2800 | 2500 | 1.05 | 5 |
| | 7 | T30 | 1.2 | 5000 | 4400 | 4000 | 1.28 | 5 |
| | 8 | T31 | 1.08 | 3550 | 3100 | 2850 | 1.27 | 5 |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-110118, filed Jun. 2, 2017, and Japanese Patent Application No. 2018-085816, filed Apr. 26, 2018, which are hereby incorporated by reference herein in their entirety.

What is claimed is:

1. An electrophotographic roller, comprising an electro-conductive substrate and an electro-conductive elastic layer as a surface layer on the electro-conductive substrate, wherein the elastic layer comprises a binder and retains a bowl-shaped resin particle having an opening in the state where the opening is exposed on a surface of the electrophotographic roller, the surface of the electrophotographic roller comprises a concave portion derived from the opening of the bowl-shaped resin particle exposed on the surface and a convex portion derived from an edge of the opening of the bowl-shaped resin particle exposed on the surface, a part of the surface of the electrophotographic roller is constituted by the elastic layer, when the electrophotographic roller is pressed on a glass plate so that a load per unit area of a nip formed by the electrophotographic roller and the glass plate is 6.5 g/mm² or more and 14.3 g/mm² or less, and a square region having a side whose length is equal to a length of the nip in a direction along a circumferential direction of the electrophotographic roller is put in the nip, in the square region, the convex portion and the glass plate are in contact with each other, and a number of the contact portion is 8 or more, an average value Save of areas of the contact portion is 10 μm² or more and 111 μm² or less, a variation coefficient S of the areas of the contact portion satisfies the following Expression (1), and a variation coefficient D of areas of Voronoi regions each including the contact portion satisfies the following Expression (2):

$$0.68 \leq S \leq 1.00 \quad \text{Expression (1)}$$

$$0.85 \leq D \leq 1.20. \quad \text{Expression (2)}$$

2. The electrophotographic roller according to claim 1, wherein a density of the contact portion is 40 portions/mm² or more and 190 portions/mm² or less.

3. The electrophotographic roller according to claim 1, wherein an average value Dave of the areas of the Voronoi regions is 1300 μm² or more and 3000 μm² or less.

4. The electrophotographic roller according to claim 1, wherein the Save is 10 μm² or more and 40 μm² or less.

5. The electrophotographic roller according to claim 1, wherein a ten-point average roughness (Rzjis) according to Japanese Industrial Standard B 0601-1994 of a surface of the elastic layer is 5 to 75 μm.

6. The electrophotographic roller according to claim 1, wherein an average concave and convex interval (Sm) according to Japanese Industrial Standard B 0601-1994 of the surface of the elastic layer is 30 to 200 μm.

7. The electrophotographic roller according to claim 1, wherein the number of the contact portion in the square region is 8 or more and 50 or less when the load is 6.5 g/mm$^2$.

8. The electrophotographic roller according to claim 1, wherein the number of the contact portion in the square region is 10 or more and 60 or less when the load is 10.9 g/mm$^2$.

9. The electrophotographic roller according to claim 1, wherein the number of the contact portion in the square region is 20 or more and 70 or less when the load is 14.3 g/mm$^2$.

10. The electrophotographic roller according to claim 1, wherein a maximum size of the bowl-shaped resin particle is 10 μm or more and 150 μm or less.

11. The electrophotographic roller according to claim 10, wherein a maximum size of the bowl-shaped resin particle is 18 μm or more and 102 μm or less.

12. The electrophotographic roller according to claim 1, wherein a volume resistivity of the elastic layer is $1\times10^2$ Ωcm or more and $1\times10^{16}$ Ωcm or less under an environment of a temperature of 23° C. and relative humidity of 50%.

13. A process cartridge attachable to and detachable from a main body of an electrophotographic apparatus, comprising an electrophotographic photosensitive member and an electrophotographic roller, wherein the electrophotographic roller comprises an electro-conductive substrate and an electro-conductive elastic layer as a surface layer on the electro-conductive substrate, the elastic layer comprises a binder and retains support a bowl-shaped resin particle having an opening in the state where the opening is exposed on a surface of the electrophotographic roller, the surface of the electrophotographic roller comprises a concave portion derived from the opening of the bowl-shaped resin particle exposed on the surface and a convex portion derived from an edge of the opening of the bowl-shaped resin particle exposed on the surface, a part of the surface of the electrophotographic roller is constituted by the elastic layer, when the electrophotographic roller is pressed on a glass plate so that a load per unit area of a nip formed by the electrophotographic roller and the glass plate is 6.5 g/mm$^2$ or more and 14.3 g/mm$^2$ or less, and a square region having a side whose length is equal to a length of the nip in a direction along a circumferential direction of the electrophotographic roller is put in the nip, in the square region, the convex portion and the glass plate are in contact with each other, and a number of the contact portion is 8 or more, an average value Save of areas of the contact portion is 10 μm$^2$ or more and 111 μm$^2$ or less, a variation coefficient S of the areas of the contact portion satisfies the following Expression (1), and a variation coefficient D of areas of Voronoi regions each including the contact portion satisfies the following Expression (2):

$$0.68 \le S \le 1.00; \quad \text{Expression (1)}$$

$$0.85 \le D \le 1.20. \quad \text{Expression (2)}$$

14. The process cartridge according to claim 13, wherein the electrophotographic roller is a charging roller, and is disposed to enable charging the electrophotographic photosensitive member.

15. An electrophotographic apparatus, comprising an electrophotographic roller and an electrophotographic photosensitive member, wherein the electrophotographic roller comprises an electro-conductive substrate and an electro-conductive elastic layer as a surface layer on the electro-conductive substrate, the elastic layer comprises a binder and retains a bowl-shaped resin particle having an opening in the state where the opening is exposed on a surface of the electrophotographic roller, the surface of the electrophotographic roller comprises a concave portion derived from the opening of the bowl-shaped resin particle exposed on the surface and a convex portion derived from an edge of the opening of the bowl-shaped resin particle exposed on the surface, a part of the surface of the electrophotographic roller is constituted by the elastic layer, when the electrophotographic roller is pressed on a glass plate so that a load per unit area of a nip formed by the electrophotographic roller and the glass plate is 6.5 g/mm$^2$ or more and 14.3 g/mm$^2$ or less, and a square region having a side whose length is equal to a length of the nip in a direction along a circumferential direction of the electrophotographic roller of the nip is put in the nip, in the square region, the convex portion and the glass plate are in contact with each other, and a number of the contact portion is 8 or more, an average value Save of areas of the contact portion is 10 μm$^2$ or more and 111 μm$^2$ or less, a variation coefficient S of the areas of the contact portion satisfies the following Expression (1), and a variation coefficient D of areas of Voronoi regions each including the contact portion satisfies the following Expression (2):

$$0.68 \le S \le 1.00; \quad \text{Expression (1)}$$

$$0.85 \le D \le 1.20. \quad \text{Expression (2)}$$

* * * * *